US010982473B1

(12) United States Patent
Pylypczak et al.

(10) Patent No.: US 10,982,473 B1
(45) Date of Patent: Apr. 20, 2021

(54) PIVOT DOOR ASSEMBLY

(71) Applicant: Teknion Limited, Toronto (CA)

(72) Inventors: Mark Pylypczak, Mississauga (CA); Hugues Gagnon, Québec (CA); Richard Dubé, Lévis (CA); Zoran Baic, Mississauga (CA); Youssef Adib, Lévis (CA); Paul Kruger, Toronto (CA)

(73) Assignee: Teknion Limited, Toronto (CA)

( * ) Notice: Subject to any disclaimer, the term of this patent is extended or adjusted under 35 U.S.C. 154(b) by 0 days.

(21) Appl. No.: 16/688,166

(22) Filed: Nov. 19, 2019

(51) Int. Cl.
*E05D 7/04* (2006.01)
*E05D 7/00* (2006.01)
*E05D 3/02* (2006.01)

(52) U.S. Cl.
CPC ..... *E05D 7/0027* (2013.01); *E05D 3/02* (2013.01)

(58) Field of Classification Search
CPC . Y10T 16/552; Y10T 16/553; Y10T 16/5535; Y10T 16/528; Y10T 16/53225; Y10T 16/5324; Y10T 16/53235; Y10T 16/53238; Y10T 16/53247; Y10T 16/5325; Y10T 16/5327; Y10T 16/527; Y10T 16/5275; E05D 3/02; E05D 7/00; E05D 7/0027; E05D 7/0045; E05D 7/04; E05D 7/0423; E05D 7/0415; E05D 7/043; E05D 2007/0072; E05D 2007/0484; E05Y 2900/20; E05Y 2900/132
See application file for complete search history.

(56) References Cited

U.S. PATENT DOCUMENTS 2,657,421 A * 11/1953 Polson ..... E05D 7/0423 16/238
3,117,827 A * 1/1964 Cecala ..... E05D 7/081 384/248
3,325,942 A * 6/1967 Bejarano ..... E05D 7/0423 49/381
3,394,428 A * 7/1968 Peterson ..... E05D 3/022 16/354
3,584,332 A * 6/1971 Taylor ..... E05D 15/266 16/245

(Continued)

FOREIGN PATENT DOCUMENTS

DE 19953927 A1 * 5/2001 ..... E06B 11/04
FR 2587058 A1 * 3/1987 ..... E05D 7/081

(Continued)

*Primary Examiner* — Chuck Y Mah
(74) *Attorney, Agent, or Firm* — Bereskin & Parr LLP/S.E.N.C.R.L., s.r.l.

(57) ABSTRACT

A pivot assembly for supporting a pivot door within a door frame includes a bottom bracket and a lower adjustment assembly that includes a pivot member. The pivot member includes a ramp inclined at an angle to a rotation axis, and a traveling assembly positionable along the ramp of the pivot member. The traveling assembly includes a traveling body, a dowel adapted to move along the ramp, and a threaded adjustment rod. The lower adjustment assembly also includes a locking fastener that is adjustable between a locked configuration and an unlocked configuration. In the unlocked configuration, rotation of the adjustment rod causes movement of the traveling assembly vertically relative to the pivot member, thereby permitting a beam of the pivot door to move vertically relative to the pivot member.

20 Claims, 11 Drawing Sheets

(56) References Cited

U.S. PATENT DOCUMENTS

| | | | | | |
|---|---|---|---|---|---|
| 3,932,913 | A * | 1/1976 | Johnson | E05D 3/022 | 16/245 |
| 4,142,272 | A * | 3/1979 | Oogami | E05D 7/0423 | 16/245 |
| 4,620,392 | A * | 11/1986 | Kerpers | E05D 7/1011 | 16/229 |
| 4,646,472 | A * | 3/1987 | Sugawara | E05F 1/123 | 16/238 |
| 4,999,876 | A * | 3/1991 | Nass | E05D 7/04 | 16/236 |
| 5,074,609 | A * | 12/1991 | Dear | E05D 7/0423 | 296/76 |
| 5,203,115 | A * | 4/1993 | Marinoni | E05D 5/0246 | 16/236 |
| 5,483,770 | A * | 1/1996 | Marinoni | E05D 7/0423 | 16/229 |
| 8,845,045 | B2 * | 9/2014 | Stubblefield | F25D 23/028 | 312/405 |
| 8,925,258 | B1 * | 1/2015 | Header | E04B 2/7401 | 52/126.4 |
| 9,605,457 | B2 * | 3/2017 | Humble | E05D 7/04 | |
| 2016/0201369 | A1 * | 7/2016 | Criddle | E05D 7/0045 | 16/238 |
| 2018/0355649 | A1 * | 12/2018 | Procton | E05B 15/0205 | |

FOREIGN PATENT DOCUMENTS

| | | | | |
|---|---|---|---|---|
| FR | 2964135 | A1 * | 3/2012 | E05D 7/0027 |
| JP | 07243279 | A * | 9/1995 | E05D 7/0027 |
| JP | 2004100316 | A * | 4/2004 | |
| JP | 2004107948 | A * | 4/2004 | E05D 7/081 |

* cited by examiner

PIVOT DOOR ASSEMBLY

FIELD

This application relates to a pivot door assembly for supporting a pivot door within a door frame.

INTRODUCTION

Known pivot door assemblies typically support a pivot door within a door frame so that the pivot door can be opened and closed. Pivot door assemblies are commonly used, for example, in residential, commercial, and industrial buildings.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect of the teachings described herein, a pivot assembly for supporting a pivot door within a door frame is provided. The door frame has a vertical jamb and a horizontal jamb, the pivot door has a beam along a vertical side edge thereof, and the beam defines a longitudinal beam channel therein. The pivot assembly comprises: a bottom bracket configured to be located at a lower end of the vertical jamb, the bottom bracket comprising a base and a pin extending upwardly from the base, the base having a lower resting surface; and a lower adjustment assembly configured to be located within the beam channel, the lower adjustment assembly comprising: a pivot member supported on the pin, the pivot member having a bottom surface and an upper portion, wherein the pivot member defines a cavity extending upwardly from the bottom surface of the pivot member, wherein the cavity is adapted to receive the pin, wherein the pivot member is rotatable relative to the bottom bracket about a lower rotation axis defined by the pin, the upper portion of the pivot member comprising a ramp inclined at an angle to the lower rotation axis; a traveling assembly positionable along the ramp of the pivot member, the traveling assembly comprising: a traveling body having a beam-engagement surface and an aperture extending from the beam-engagement surface through the traveling body; a dowel defining a threaded transverse dowel bore therethrough, wherein the dowel is adapted to move along the ramp; and a threaded adjustment rod configured to couple the dowel and the traveling body, wherein the adjustment rod is adapted to pass through the aperture of the traveling body and threadedly engage the transverse dowel bore; wherein the beam-engagement surface of the traveling body is configured to be secured to the beam, a locking fastener configured to operatively couple the pivot member to the beam, the locking fastener being adjustable between a locked configuration and an unlocked configuration, wherein, in the locked configuration, the locking fastener is adapted to secure the pivot member to the beam, and wherein, in the unlocked configuration, the locking fastener permits movement of the beam in a vertical direction relative to the pivot member; and wherein, in the unlocked configuration, rotation of the adjustment rod causes movement of the traveling assembly vertically relative to the pivot member, thereby permitting the beam to move vertically relative to the pivot member.

In some embodiments, in the unlocked configuration, rotation of the adjustment rod moves the dowel of the traveling assembly along the ramp of the pivot member.

In some embodiments, the aperture of the traveling body has a countersunk portion and the adjustment rod comprises a head configured to sit in the countersunk portion substantially flush with the beam-engagement surface.

In some embodiments, the head of the adjustment rod has a hex-shaped axial opening defined therein, wherein the hex-shaped axial opening is accessible via an access hole defined through a side of the beam and is configured to engage an Allen key.

In some embodiments, the bottom bracket further comprises a plate extending generally upwardly and perpendicularly from the base, wherein the plate is securable to the lower end of the vertical jamb.

In some embodiments, the plate is configured to at least partially fit within a longitudinally extending jamb channel defined by a recessed portion of the vertical jamb.

In some embodiments, a transverse threaded aperture is defined in a side surface of the pivot member, wherein the locking fastener comprises a threaded fastener having a head, and wherein the locking fastener is configured to threadedly engage the aperture of the pivot member, wherein the locking fastener is configured to pass through a longitudinally extending adjustment slot defined in a side of the beam to releasably secure the beam to the pivot member in the locked configuration, wherein, in the unlocked configuration, the adjustment slot permits movement of the beam relative to the pivot member.

In some embodiments, the traveling body has at least one threaded hole defined in the beam-engagement surface, wherein the traveling assembly further comprises at least one beam-engagement fastener, wherein, the at least one beam-engagement fastener is configured to threadedly engage the at least one hole defined in the beam-engagement surface, wherein the beam-engagement fastener passes through a corresponding hole defined through a side the beam to secure the beam to the traveling body.

In some embodiments, the base of the bottom bracket comprises a recessed sliding surface supporting a block configured for generally horizontal sliding movement along the sliding surface, the pin extending upwardly from the block, wherein horizontal movement of the pin shifts the lower rotation axis.

In some embodiments, the bottom bracket further comprises at least one set screw configured to releasably secure the block in a predetermined position on the sliding surface.

In some embodiments, the pivot assembly further comprises an upper adjustment assembly, the upper adjustment assembly comprising: a top bracket having a bore defined therethrough; at least one upper locking fastener configured to releasably secure the top bracket to the horizontal jamb, the at least one upper locking fastener being adjustable between a first configuration and a second configuration, wherein, in the first configuration, the at least one upper locking fastener is adapted to secure the top bracket to the horizontal jamb, and wherein, in the second configuration, the top bracket is movable in a horizontal direction; and a plunger assembly configured to be located within the beam channel, the plunger assembly comprising a plunger moveable between a retracted position and an extended position, wherein, in the retracted position, the plunger is located within the beam channel, wherein, in the extended position, the plunger extends from the beam channel and is adapted to be received in the bore, thereby permitting pivoting of the plunger assembly relative to the top bracket about an upper rotation axis defined by a longitudinal axis of the plunger; wherein, in the second configuration, horizontal movement of the top bracket horizontally shifts the upper rotation axis.

In some embodiments, the top bracket defines least one slotted opening therein, wherein the at least one upper locking fastener is configured to pass through the at least one slotted opening and engage the horizontal jamb to releasably secure the top bracket to the horizontal jamb, and wherein, in the second configuration, the at least one upper locking fastener is adapted for movement along the at least one slotted opening.

In some embodiments, the top bracket is configured to substantially fit within a longitudinally extending jamb channel defined by a recessed portion of the horizontal jamb, and wherein, when the top bracket is releasably secured to the horizontal jamb within the horizontal jamb channel, wherein a lower surface of the top bracket is generally flush with the horizontal jamb.

In some embodiments, the plunger assembly further comprises a main body configured to be secured to the beam, the main body having an upper end, a lower end, and a body channel defined partially therethrough, the body channel extending from an open top end at the upper end of the main body to a closed bottom end proximate the lower end of the main body, wherein the plunger is moveable along the channel, wherein, in the extended position, the plunger extends from the upper end of the main body, and wherein, in the retracted position, the plunger is retracted within the main body.

In some embodiments, the plunger assembly further comprises a threaded locking pin configured to releasably secure the plunger to the main body to prevent movement of the plunger.

In some embodiments, the main body comprises a beam-engagement side securable to the beam, the beam-engagement side having a longitudinally extending elongated body slot defined therein, wherein the body slot is generally aligned with a corresponding longitudinally extending elongated access slot defined though a side of the beam, wherein the plunger has a transverse plunger bore defined therein, wherein the locking pin is configured to pass through the body slot and the access slot to threadedly engage the transverse plunger bore.

In some embodiments, the plunger assembly further comprises a spring located in the channel between the closed end of the channel a lower end of the plunger, wherein the spring is configured to bias the plunger toward the extended position.

In some embodiments, the beam-engagement side of the main body has at least one threaded aperture defined therein, wherein the plunger assembly further comprises the at least one fastener configured to pass through the beam and threadedly engage the threaded aperture, thereby securing the main body to the beam.

According to another broad aspect of the teachings described herein, a pivot assembly for a door frame having a vertical jamb is provided. The vertical jamb has an upper end a lower end. The pivot assembly comprises: a generally vertical beam configured to be positioned proximate to the vertical jamb, the beam defining a longitudinal beam channel therein; a bottom bracket located at the lower end of the vertical jamb, the bottom bracket comprising a base and a pin extending upwardly from the base, the base having a lower resting surface; and a lower adjustment assembly positionable within the beam channel, the lower adjustment assembly comprising: a pivot member supported on the pin, the pivot member having a bottom surface and an upper portion, wherein the pivot member defines a cavity extending upwardly from the bottom surface of the pivot member, wherein the cavity is adapted to receive the pin, wherein the pivot member is rotatable relative to the bottom bracket about a lower rotation axis defined by the pin, the upper portion of the pivot member comprising a ramp inclined at an angle to the lower rotation axis; a traveling assembly positionable along the ramp, the traveling assembly comprising: a traveling body having a beam-engagement surface and an aperture extending from the beam-engagement surface through the traveling body; a dowel defining a threaded transverse dowel bore therethrough, wherein the dowel is adapted to move along the ramp; and a threaded adjustment rod configured to couple the dowel and the traveling body, wherein the adjustment rod is adapted to pass through the aperture of the traveling body and threadedly engage the transverse dowel bore; wherein the beam-engagement surface of the traveling body is configured to be secured to the beam, a locking fastener configured to operatively couple the pivot member to the beam, the locking fastener being adjustable between a locked configuration and an unlocked configuration, wherein, in the locked configuration, the locking fastener is adapted to secure the pivot member to the beam, and wherein, in the unlocked configuration, the beam is movable in a vertical direction relative to the pivot member; and wherein, in the unlocked configuration, rotation of the adjustment rod causes vertical movement of the traveling assembly relative to the pivot member, thereby permitting the beam to move vertically relative to the pivot member.

In some embodiments, the base of the bottom bracket comprises a recessed sliding surface supporting a block configured for generally horizontal sliding movement along the sliding surface, the pin extending upwardly from the block, wherein horizontal movement of the pin shifts the lower rotation axis.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
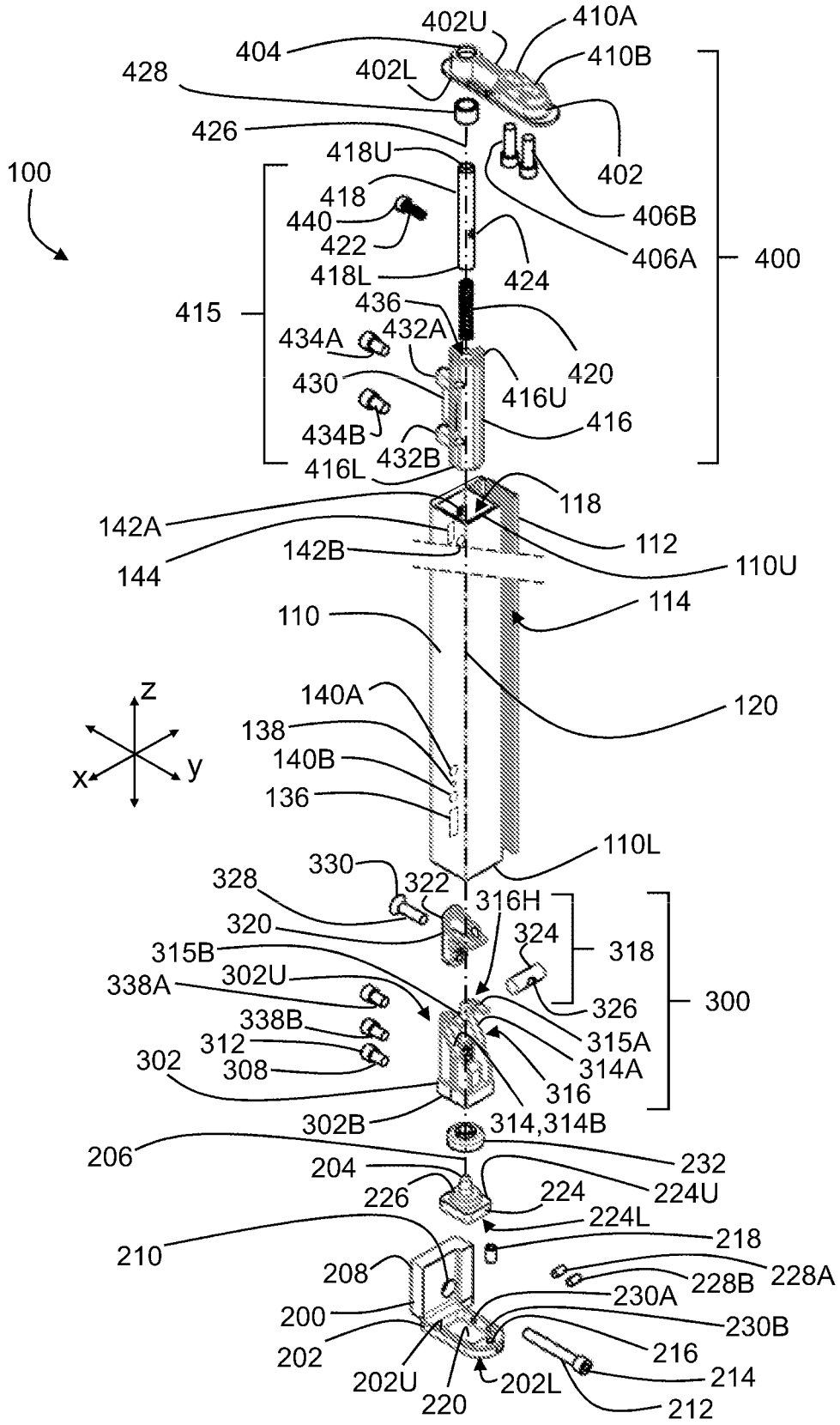
FIG. 1 is a partial exploded perspective view of an example pivot door assembly.

The drawings included herewith are for illustrating various examples of articles, methods, and apparatuses of the teaching of the present specification and are not intended to limit the scope of what is taught in any way.

DETAILED DESCRIPTION

Various apparatuses, methods, and compositions are described below to provide an example of an embodiment of each claimed invention. No embodiment described below limits any claimed invention and any claimed invention may cover apparatuses and methods that differ from those described below. The claimed inventions are not limited to apparatuses, methods, and compositions having all of the features of any one apparatus, method or composition described below or to features common to multiple or all of the apparatuses, methods, or compositions described below. It is possible that an apparatus, method, or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

The terms "an embodiment," "embodiment," "embodiments," "the embodiment", "the embodiments", "one or more embodiments", "some embodiments", and "one embodiment" mean "one or more (but not all) embodiments of the present invention(s)", unless expressly specified otherwise.

The terms "including", "comprising", and variations thereof mean "including but not limited to", unless expressly specified otherwise. A listing of items does not imply that any or all of the items are mutually exclusive, unless expressly specified otherwise. The terms "a", "an", and "the" mean "one or more", unless expressly specified otherwise.

The use of the words "vertical", "vertically", "horizontal" and "horizontally" are used herein to indicate orientation of elements once installed, and are therefore not intended to be used in a limiting way.

FIG. 1 illustrates an exemplary pivot door assembly, referred to generally as 100, for supporting a pivot door within a door frame. The pivot door, when supported by the pivot door assembly 100 within the door frame, may be selectively opened and closed.

The pivot door assembly 100 includes a beam 110 that extends longitudinally between an upper beam end 110U and a lower beam end 110L. The beam 110 is securable to a vertical side edge of the pivot door. The beam 110 can be secured along the vertical side edge of the pivot door in a number of suitable ways, e.g. by clamping, welding, gluing, etc. Alternatively, the beam 110 and the pivot door can be integrally formed with the vertical side edge of the pivot door.

Figure 9:
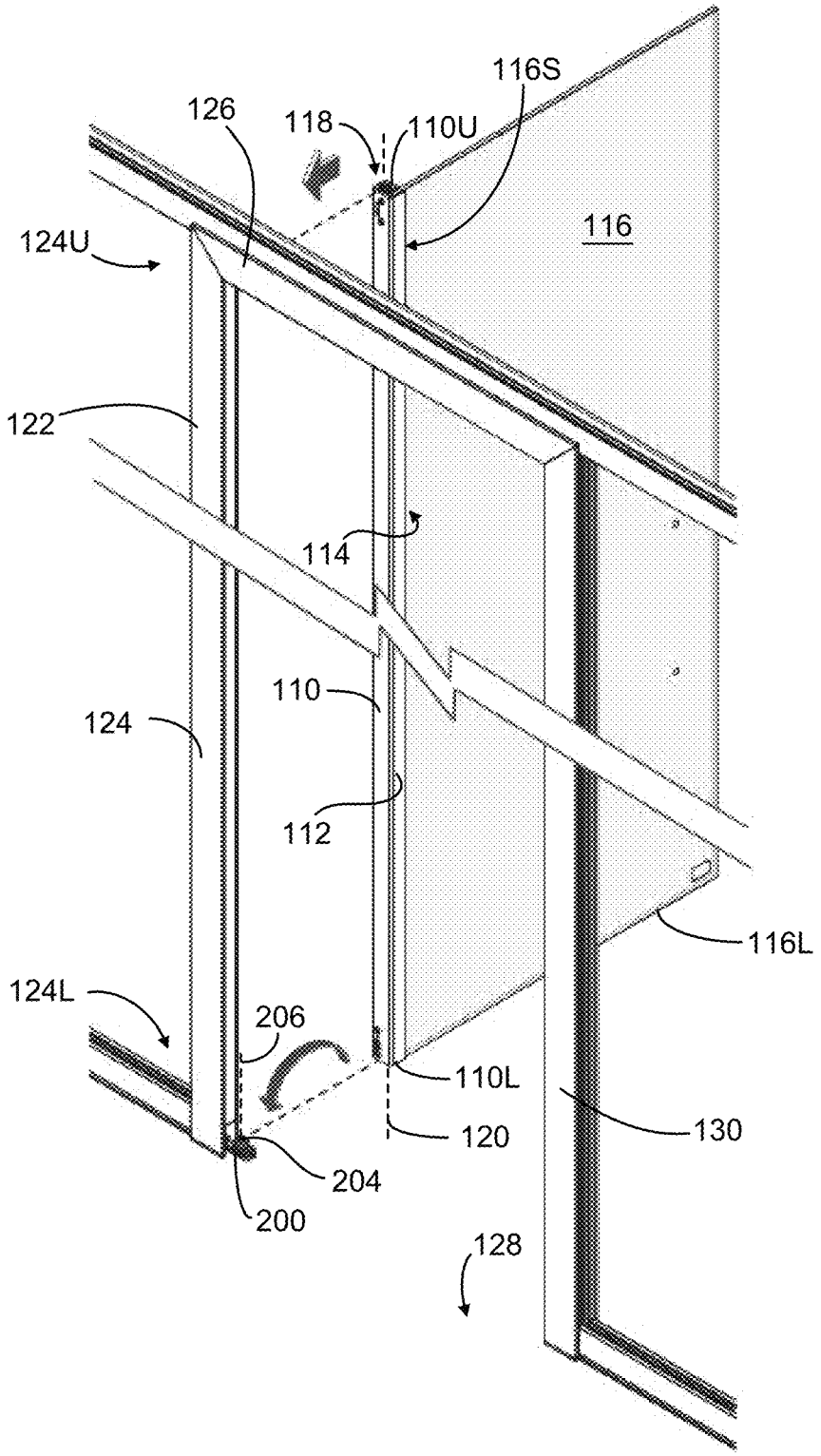
FIG. 9 is an exploded perspective view showing a pivot door positioned for securement within a door frame using the pivot door assembly of FIG. 1.

In the illustrated example, the beam 110 includes a flange 112 that extends between the upper and lower beam ends 110U and 110L. The flange 112 and the beam 110 define a retaining slot 114 therebetween. Turning to FIG. 9, a vertical side edge 116S of a pivot door 116 is receivable within the retaining slot 114. In some cases, an adhesive can be added within the retaining slot 114 to strengthen the connection between the beam 110 and the vertical side edge 116S of the pivot door 116. In one or more alternative embodiments, the flange 112 may extend along only a portion of the beam 110 between the upper and lower beam ends 110U and 110L.

With continued reference to FIG. 9, the pivot door 116 may be made from a number of suitable materials, whether transparent, translucent, or opaque. In the illustrated example, the pivot door 116 is made from a glass material.

Figure 11:
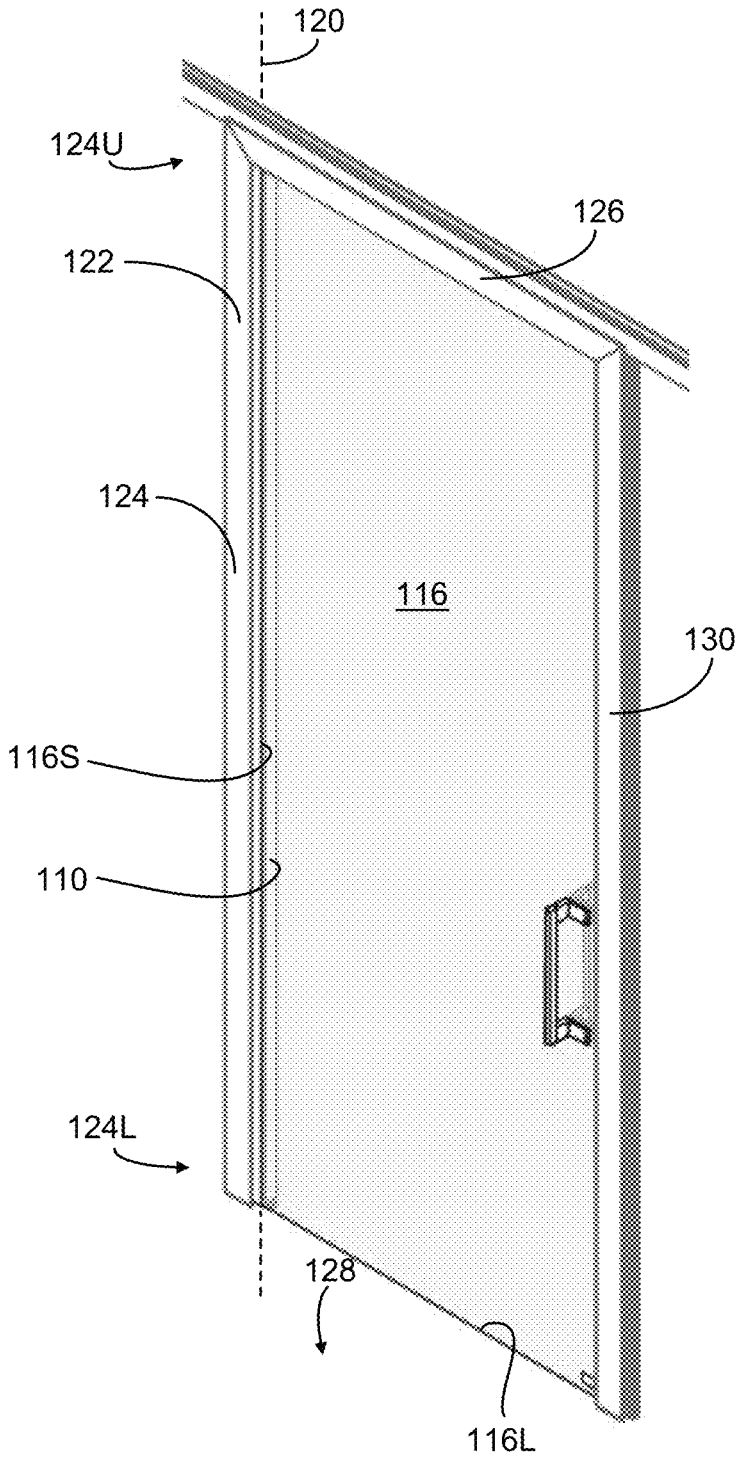
FIG. 11 is a perspective view showing the pivot door of FIG. 9 supported within the door frame with the pivot door assembly shown in FIG. 1.

Returning to FIG. 1, the beam 110 defines a longitudinal beam channel 118 therein. In the illustrated example, the beam 110 is a hollow extrusion having a generally square-shaped cross-section. The hollow interior volume of the beam 110 extending between the upper and lower beam ends 110U and 110L forms the beam channel 118. Those skilled in the art will understand that the beam 110 can have any other suitable cross-section, such as a rectangular cross-section. The beam 110 also defines a pivot axis 120 extending generally longitudinally through the beam channel 118. Turning to FIG. 11, the pivot door 116 can be rotated about the pivot axis 120 when supported in a door frame 122 by the pivot door assembly 100.

With continued reference to FIG. 11, the door frame 122 includes a vertical jamb 124 and a horizontal jamb 126 extending generally perpendicularly from an upper end 124U of the vertical jamb 124. A lower end 124L of the vertical jamb 124 is supported above a surface 128, such as a floor. The lower end 124L of the vertical jamb 124 can be secured to the floor 128 to improve stability. In the illustrated example, the door frame 122 includes two generally parallel vertical jambs 124, 130 extending between opposite ends of the horizontal jamb 126 and the floor 128.

As will be described in more detail below, the pivot door assembly 100 may permit the pivot door 116 to be spaced from the floor 128 and/or the at least one vertical jamb 124. Put alternatively, the pivot door assembly 100 enables adjustment of the position of the pivot door 116 within the door frame 122. The pivot door assembly 100 may provide one or more advantages. For example, assembly and/or installation of the pivot door 116 may be simplified by allowing an assembler and/or installer to align the pivot door 116 within the door frame 122. In this way, the pivot door assembly 100 may enable smooth rotation of the pivot door 116 as it is opened and closed. In addition, if the pivot door 116 becomes misaligned through repeated use, the pivot door assembly 100 may be used to realign the pivot door 116.

Figure 2:
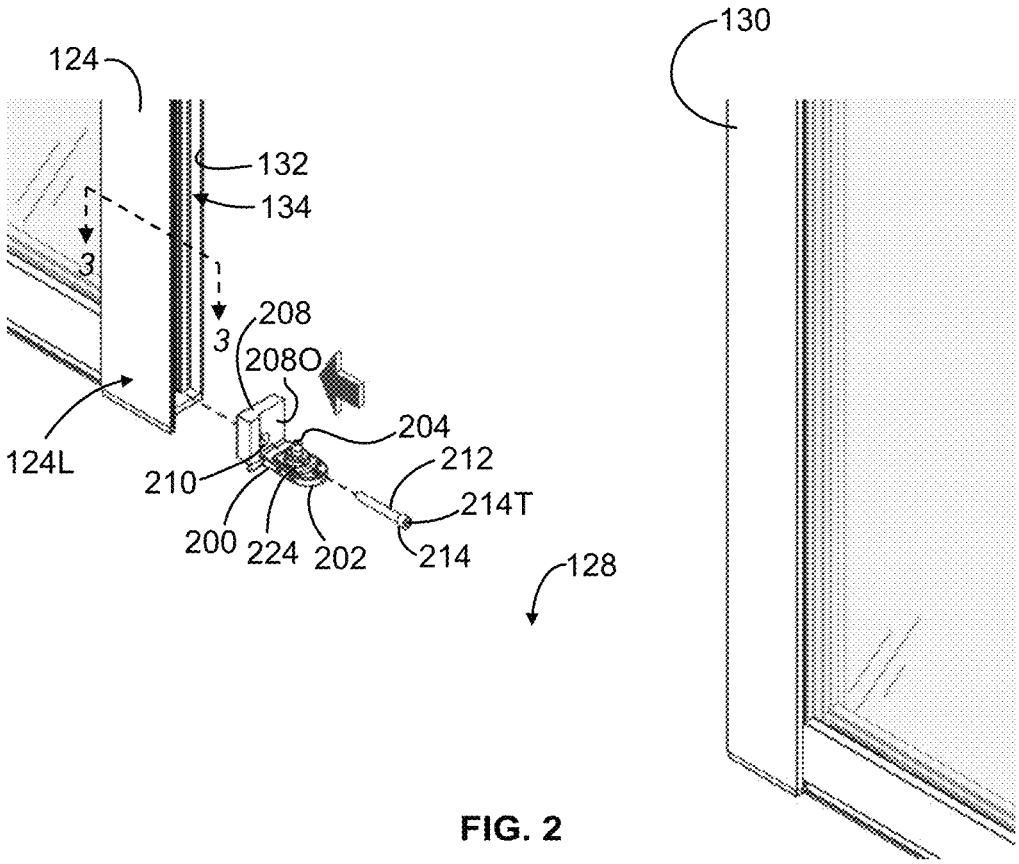
FIG. 2 is a partial exploded perspective view showing a bottom bracket of the pivot door assembly shown in FIG. 1 and the door jamb.

Referring to FIGS. 1 and 2, the pivot door assembly 100 also includes a bottom bracket 200 located at a lower end 124L of the vertical jamb 124 (shown in FIG. 2). The bottom bracket 200 includes a base 202 and a pin 204 extending upwardly from the base 202. The base has a lower resting surface 202L. The lower resting surface 202L is rests on the surface 128. The pin 204 defines a lower rotation axis 206. As will be described in more detail below, the pivot door 116 can rotate about the lower rotation axis 206 defined by the pin 204.

In the illustrated example, the bottom bracket 200 also includes a plate 208 extending generally upwardly and perpendicularly from the base 202, thereby giving the bottom bracket 200 an L-shape appearance. The bottom bracket 200 may be secured to the vertical jamb 124 at the lower end 124L in a number of suitable ways, e.g. by mechanical fasteners, adhesive, etc.

FIG. 2 shows an example of the bottom bracket 200 being secured to the vertical jamb 124 at the lower end 124L. As shown, a bolt 212 passes into the vertical jamb 124 through a bore 210 defined in the plate 208 to secure the bottom bracket 200 to the vertical jamb 124. A head 214 of the bolt 212 may have a hex-shaped axial opening (not shown) to engage an Allen key.

Figure 3:
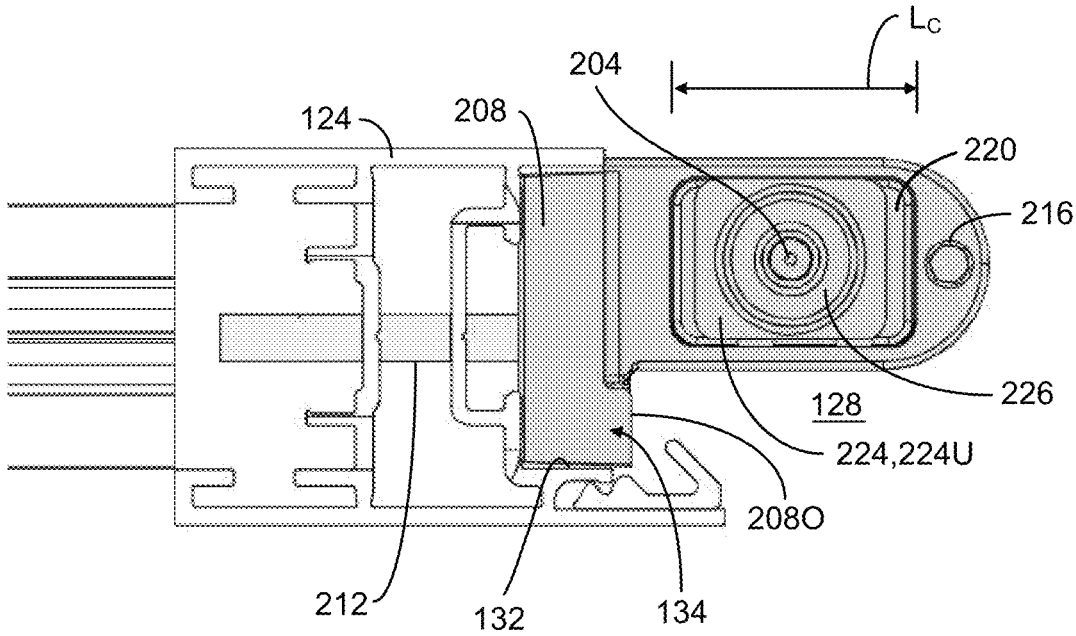
FIG. 3 is a cross-sectional view taken along line 3-3 of FIG. 2 showing the bottom bracket secured to the lower end of the vertical jamb.

FIG. 3 shows the bottom bracket 200 secured to the lower end of the vertical jamb 124 by the bolt 212. In some cases, the lower end 124L of the vertical jamb 124 includes a receiving aperture (not shown) cut to receive the bolt 212. In the illustrated example, the bore 210 defined in the plate 208 is countersunk. With reference to FIGS. 2 and 3, when the bottom bracket 200 is secured to vertical jamb 124, a top surface 214T of the head 214 sits substantially flush with, or below, an outer surface 2080 of the plate 208. In this way, the head 214 of bolt 212 may not obstruct rotation of the pivot door 116.

With continued reference to FIG. 3, the vertical jamb 124 has a longitudinally extending recessed portion 132 defining a jamb channel 134. The plate 208 of the bottom bracket 200 fits within the jamb channel 134 to provide an aesthetically pleasing appearance.

Optionally, the base 202 of the bottom bracket 200 can be secured to the floor 128 to improve stability. The base 202 can be secured to the floor 128 in a number of suitable ways, e.g. by mechanical fasteners, adhesive, etc. In the illustrated example, the base 202 has a threaded aperture 216 defined therethrough. As shown in FIG. 1, a set screw 218 is received in the aperture 216 and passes into the floor 128 to secure the base 202 to the floor 128. The threading of the set screw 218 is omitted from FIG. 1 for clarity.

In one or more alternative embodiments, the bottom bracket 200 may be secured to the floor 128, e.g. as described above, without being secured to the vertical jamb 124.

Referring again to FIG. 1, base 202 includes a recessed sliding surface 220 supporting a block 224 having an upper surface 224U and a lower surface 224L. In the illustrated example, the upper surface 224U of block 224 has a raised portion 226. As will be described in more detail below, the raised portion 226 may offer one or more advantages. The raised portion 226 may be cylindrical, e.g. as shown. The pin 204 extends upwardly from the raised portion 226. In one or more alternative embodiments, the raised portion 226 of the upper surface 224U may be omitted. In such embodiments, the pin 204 extends upwardly from the block 224.

The lower surface 224L of the block 224 is supported by the recessed sliding surface 220. The block 224 can slide on the recessed sliding surface 220 of the base 202. In the illustrated example, the block 224 is slideable horizontally on the recessed sliding surface 220. Horizontal movement of the pin 204 shifts the lower rotation axis 206 defined by the pin 204. As will be described in more detail below, the block 224 can be slid to space the pivot door 116 from the vertical jamb 124 at the lower end 124L thereof.

Continuing to refer to FIG. 1, set screws 228A and 228B are provided to lock the block 224 in a predetermined position on the sliding surface 220. The set screws locate in corresponding threaded holes 230A and 230B defined on the base 202. In the illustrated example, each of the set screws 228A and 228B include an end defining a hex-shaped axial opening configured to engage an Allen key or the like. The threading of the set screws 228A and 228B is omitted from FIG. 1 for clarity.

Referring to FIG. 1, the pivot door assembly 100 also includes a lower adjustment assembly 300 that locates within the beam channel 118. As will be described in more detail below, the lower adjustment assembly 300 rotates on the pin 204 of the bottom bracket 200. The lower adjustment assembly 300 includes a pivot member 302 having an upper portion 302U and a bottom surface 302B.

Figure 4A:
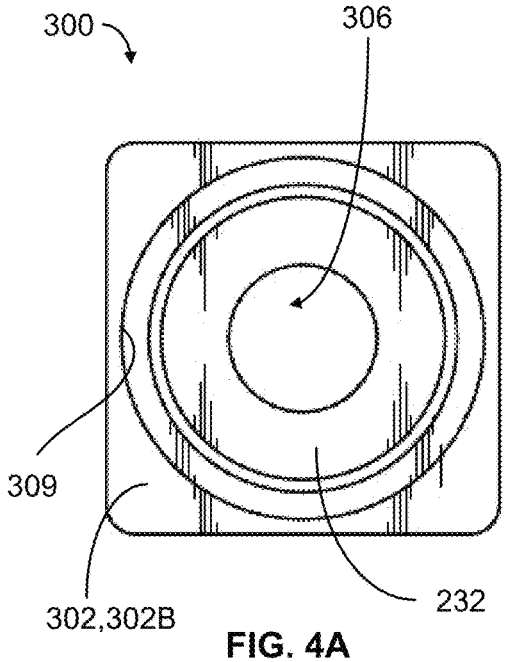
FIG. 4A is a bottom view of a lower adjustment assembly of the pivot door assembly shown in FIG. 1.

Turning to FIG. 4A, the pivot member 302 has a cavity 306 extending upwardly from the bottom surface 302B of the pivot member 302. In the illustrated example, the cavity 306 is cylindrical. The cavity 306 receives the pin 204 of the bottom bracket 200. In the illustrated example, the pivot member 302 is located within the beam channel 118 at the bottom beam end 110L. When the pin 204 is received in the cavity 306, the pivot door 116 rotates relative to the bottom bracket 200 about the lower rotation axis 206 defined by the pin 204. In this arrangement, the lower rotation axis 206 defined by the pin 204 is generally co-axial with the pivot axis 120 defined by the beam 110.

Referring to FIGS. 1 and 2, sliding the block 224 on the recessed sliding surface 220 allows the horizontal distance from the pivot door 116 to the lower end 124L of the vertical jamb 124 to be adjusted. Sliding the block 224 on the recessed sliding surface 220 shifts the lower rotation axis 206 defined by the pin 204 which, in turn, shifts the pivot axis 120 defined by the beam 110. Referring to FIG. 3, a lower horizontal adjustment range provided by the bottom bracket 200 is determined by a length $L_C$ of the recessed sliding surface 220. It will be appreciated that the longer the length $L_C$ of the recessed sliding surface 220, the longer the horizontal adjustment range will be.

Returning to FIG. 1, the pivot door assembly 100 optionally includes a bushing 232 configured to positioned around the pin 204 of the bottom bracket 200. In the illustrated example, the bushing 232 is supported by the raised portion 226 of the block 224. The raised portion 226 separates the bottom surface 302B of the pivot member 302 from the upper surface 202U of the base 202.

Referring to FIG. 4A, the bushing 232 is received in the cavity 306. The bushing 232 may improve rotation of the pivot member 302 about the pin 204 and may generally improve the stability of the pivot door assembly 100.

Referring to FIG. 1, the lower adjustment assembly 300 also includes a threaded locking fastener 308 to secure the pivot member 302 to the beam 110. The threading of the locking fastener 308 is omitted from FIG. 1 for clarity.

The locking fastener 308 is adjustable between a locked configuration and an unlocked configuration. In the locked configuration, the locking fastener 308 is tightened to secure the pivot member 302 to the beam 110. In the unlocked configuration, the locking fastener is loosened to permit the beam 110 to move in a vertical direction relative to the pivot member 302. Put alternatively, in the unlocked configuration, the beam 110 is capable of moving vertically without concurrent vertical movement of the pivot member 302.

Figure 4B:
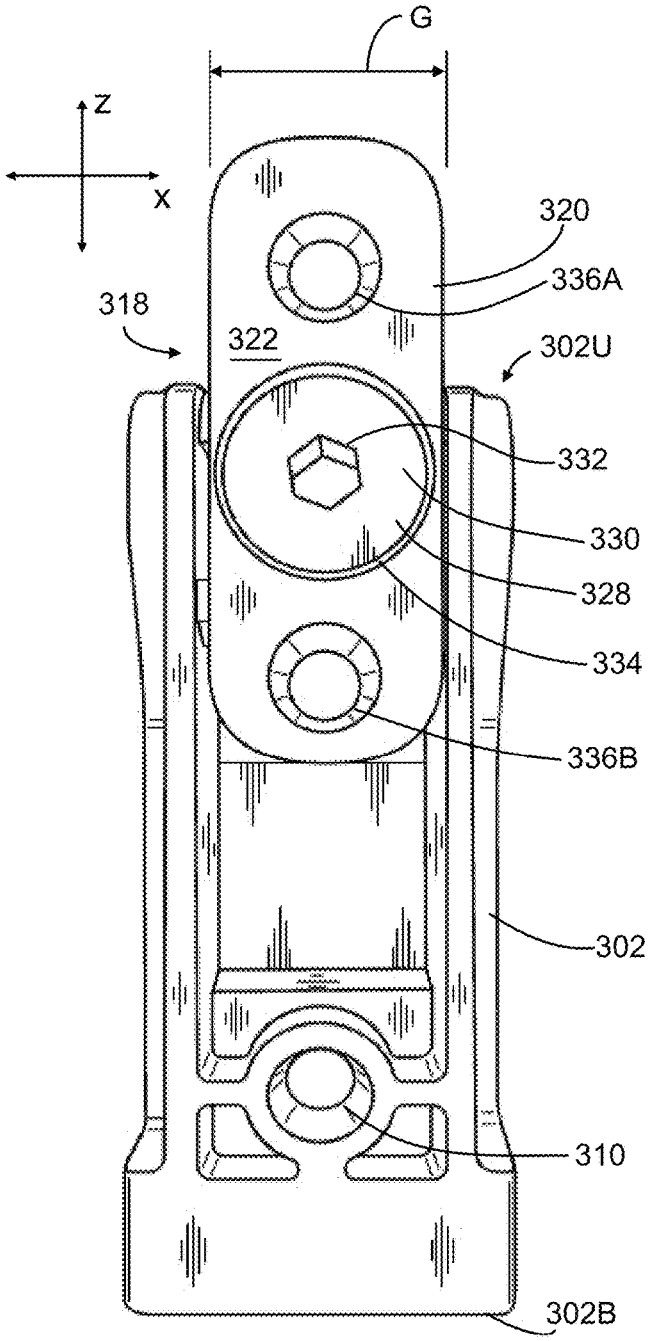
FIG. 4B is a front elevation view of the lower adjustment assembly shown in FIG. 4A.

Turning to FIG. 4B, a horizontal threaded aperture 310 is defined in a side surface of the pivot member 302. The locking fastener 308 (shown in FIG. 1) is received in the threaded aperture 310 of the pivot member 302. The locking fastener 308 passes through a longitudinally extending adjustment slot 136 defined in a side of the beam 110 to secure the beam 110 to the pivot member 302 in the locked configuration. The adjustment slot 136 permits movement of the beam 110 relative to the locking fastener 308 and the pivot member 302 when the locking fastener 308 is in the unlocked configuration.

Returning to FIG. 1, the locking fastener 308 includes a head 312. In the locked configuration, a portion of the beam 110 surrounding the adjustment slot 136 is pressed between the head 312 of the locking fastener 308 and the pivot member 302. In this arrangement, the locking fastener 308 can prevent relative movement between the beam 110 and the pivot member 302.

Conversely, in the unlocked configuration, the head 312 of the locking fastener 308 is moved away when the locking fastener 308 is loosened. In the unlocked configuration, the locking fastener 308 moves along the adjustment slot 136 in response to moving the beam 110 vertically relative to the pivot member 306.

The head 312 of the locking fastener 308 preferably defines a hex-shaped axial opening configured to engage an Allen key or the like. For example, the Allen key can be used to adjust the locking fastener between the locked and unlocked configurations.

Figure 4C:
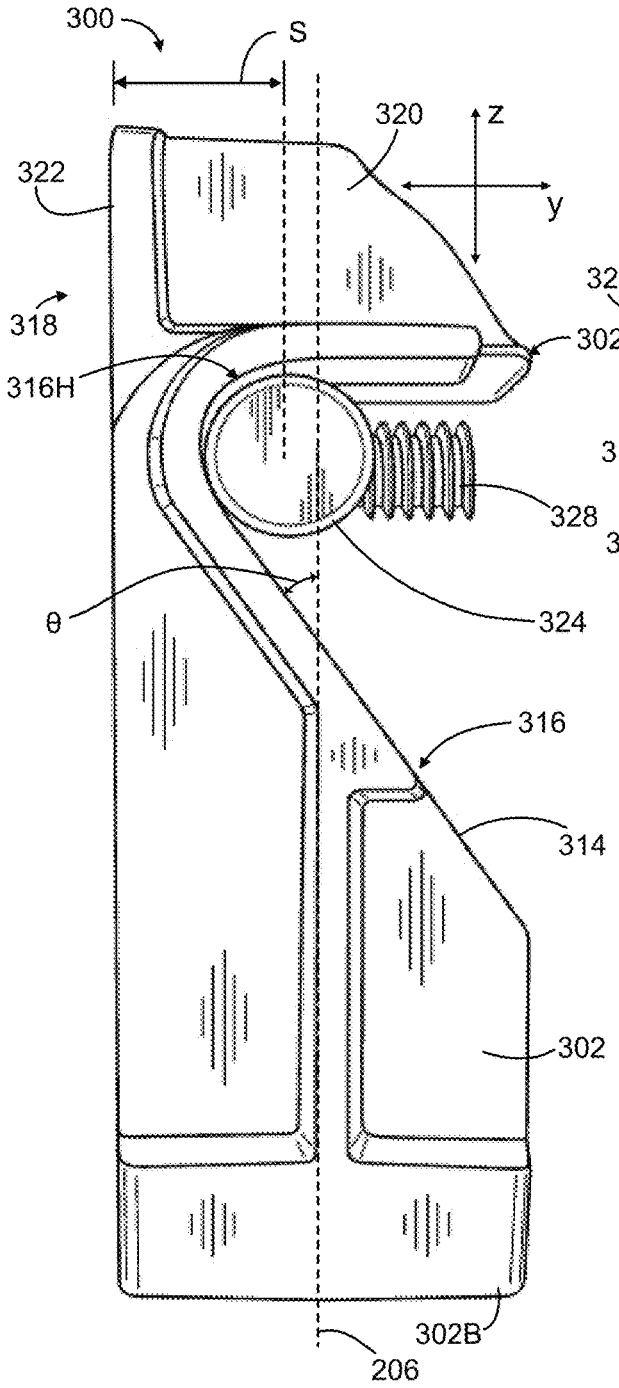
FIGS. 4C and 4D are side elevation views of the lower adjustment assembly shown in FIG. 4A showing a traveling assembly of the lower adjustment assembly in different positions.

Turning to FIG. 4C, the upper portion 302U of the pivot member 302 has an inclined surface 314 defining a ramp 316. When assembled, the ramp 316 is inclined at an angle θ to the lower rotation axis 206 defined by the pin 204. The angle θ is preferably between 20 and 60 degrees. In the illustrated example, the inclined surface 314 comprises inclined surfaces 314A and 314B which define the ramp 316. As best shown in FIG. 1, the inclined surfaces 314A and 314B are generally parallel to each other.

Figure 4D:
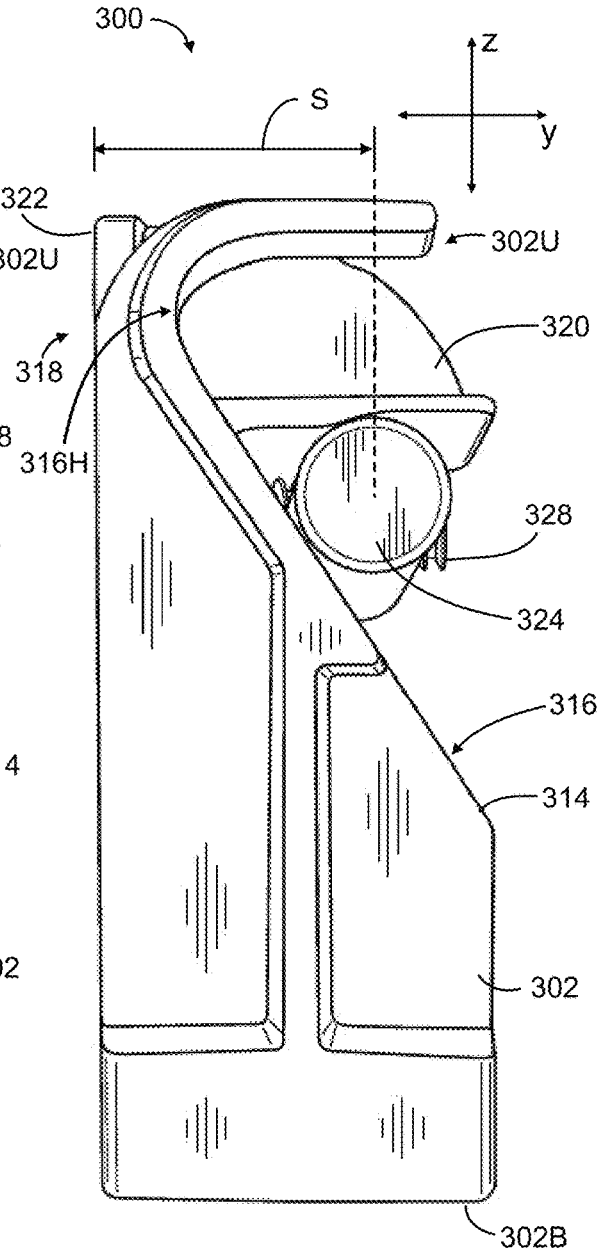

Returning to FIG. 1, the lower adjustment assembly 300 also includes a traveling assembly 318 positionable along the ramp 316 of the pivot member 302. The traveling assembly 318 includes a traveling body 320 having a beam-engagement surface 322. The traveling assembly 318 also includes a dowel 324. The dowel has a threaded transverse dowel bore 326. As shown in FIGS. 4C-4D, the dowel 324 moves along the ramp 316 of the pivot member 302.

Referring to FIG. 1, the traveling assembly 318 also includes a threaded adjustment rod 328 which couples the dowel 324 and the traveling body 320. The threading of the adjustment rod 328 is omitted from FIG. 1 for clarity.

Returning to FIG. 4B, the adjustment rod 328 includes a head 330. The head 330 of the adjustment rod 328 preferably has a hex-shaped axial opening 332 to engage an Allen key or the like. The traveling body 320 has an aperture 334 extending from the beam-engagement surface 322 through the traveling body 320. With reference to FIGS. 4B-4C, the adjustment rod 328 passes through the aperture 334 of the traveling body 320 and is received in the transverse dowel bore 326.

With reference to FIGS. 1 and 4B, the traveling body 320 fits within a gap G defined between the surfaces 314A and 314B.

In the illustrated example, the aperture 334 of the traveling body 320 has a countersunk portion. The head 330 of the adjustment rod 328 sits in the countersunk portion substantially flush with the beam-engagement surface 322. As shown in FIG. 4C, the head 330 of the adjustment rod 328 does not protrude from the beam-engagement surface 322 of the traveling body 320. This arrangement allows the beam-engagement surface 322 of the traveling body 320 to sit flush against beam 110 within the beam channel 118.

Returning to FIG. 1, the hex-shaped axial opening 332 of the head 330 is accessible via an access hole 138 defined through a side of the beam 110 to permit access by an Allen key or the.

With reference to FIGS. 1 and 4B, the traveling assembly 318 can be secured to the beam 110 in a number of suitable ways, e.g. by mechanical fasteners, adhesive, etc. In the illustrated example, the traveling body 320 has threaded holes 336A and 336B in the beam-engagement surface 322. As shown in FIG. 4B, the threaded holes 336A and 336B are located above and below the aperture 334, respectively, in the beam-engagement surface 322. It will be appreciated that other configurations are possible. Referring specifically to FIG. 1, the traveling assembly 318 also includes beam-engagement fasteners 338A and 338B to locate in the holes 336A and 336B, respectively. The beam-engagement fasteners 338A and 338B pass through corresponding holes 140A and 140B defined though a side of the beam 110 to secure the beam 110 to the traveling body 320.

In the illustrated example, two beam-engagement fasteners (i.e. fasteners 338A and 338B) are used to secure the traveling body 320 to the beam 110. It will be appreciated that using two fasteners may provide a stronger connection of the traveling body 320 to the beam 110. In one or more alternative embodiments, one beam-engagement fastener or more than two fasteners may be used to secure the traveling body 320 to the beam 110. In such embodiments, the traveling body 320 may have a corresponding number of threaded holes in the beam-engagement surface 322.

Returning to FIG. 9, the lower adjustment assembly 300 may be inserted into the beam channel 118 from the lower beam end 110L. The pivot member 302 and the traveling assembly 318 of the lower adjustment assembly 300 are then secured to the beam 110, e.g. as described above.

The pivot member 302 of the lower adjustment assembly 300 is located within the beam channel 118 so that, when secured to the beam 110, the bottom surface 302B of the pivot member 302 is positioned proximate the lower beam end 110L. This arrangement allows the pin 204 of the bottom bracket 200 to extend into the cavity 306 of the pivot member 302.

Figure 12A:
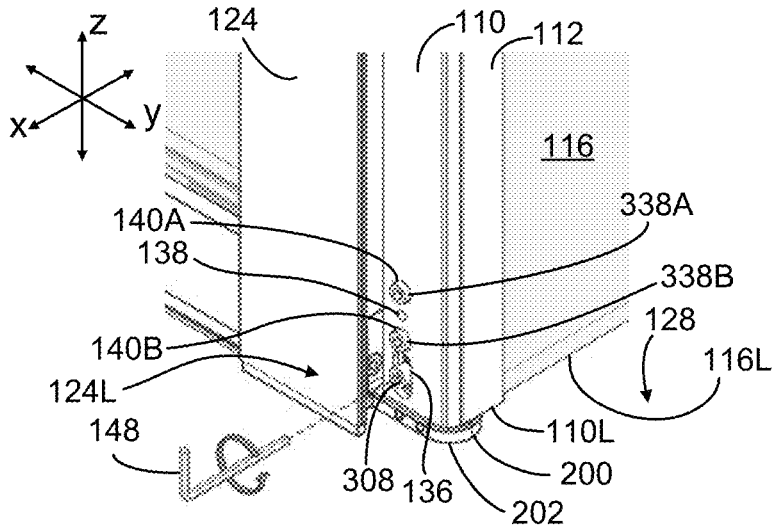
FIGS. 12A-12C are partial perspective views showing adjustment of a lower edge of the pivot door of FIG. 9 with the pivot door assembly shown in FIG. 1.

Turning to FIG. 12A, the adjustment slot 136 (as well as the holes 140A and 140B) can be located in a side of the beam 110 to provide the desired positioning of the lower adjustment assembly 300 within the beam channel 118.

Referring to FIGS. 1 and 4C-4D, when the locking fastener 308 is in the unlocked configuration, rotation of the adjustment rod 328 actuates movement of the traveling assembly 318 vertically relative to the pivot member 302, thereby permitting the beam 110 to move vertically relative to the pivot member 302. This operation is described in more detail below.

The beam-engagement surface 322 is held against an internal surface of the beam 110 (e.g. as described above). In this arrangement, the adjustment rod 328 is restrained from moving in an axial direction when rotated. Consequently, rotating the adjustment rod 328 moves the dowel 324 along the adjustment rod 328.

Referring to FIGS. 4C-4D, as the dowel 324 moves away from the beam-engagement surface 322 (i.e. away from the head 330 of the adjustment rod 328), a separation S between the dowel 324 and the beam-engagement surface 322 increases. As the separation S increases, the dowel 324 moves down the ramp 316 to maintain contact with the ramp 316. Conversely, as the dowel 324 moves closer to the beam-engagement surface 322 (i.e. toward the head 330 of the adjustment rod 328), the separation S decreases and the dowel 324 moves up the ramp 316.

FIGS. 4C and 4D show the traveling assembly 318 of the lower adjustment assembly 300 in different positions. FIG. 4C shows the traveling assembly 318 in a highest position in which the dowel 324 is sitting at a top portion of the ramp 316. Since the traveling assembly 318 is secured to the beam 110, e.g. as discussed above, when the traveling assembly 318 is in the highest position, a lower edge 116L of the pivot door 116 is at a maximum vertical separation from the floor 128.

In some embodiments, the upper end 302U of the pivot member 302 includes a restraining flange. The restraining flange is preferably positioned above the ramp 316 to prevent the dowel 324 of the traveling assembly 318 from disengaging the ramp 316. For example, when the traveling assembly 318 is moving up the ramp 316, the restraining flange may prevent disengagement of the dowel 324 of traveling assembly 318 with the ramp 316 caused by over-rotation of the adjustment rod 328. In the illustrated example, the upper end 302U of the pivot member 302 includes rounded retaining flanges 315A and 315B. Referring to FIG. 1, the rounded retaining flanges 315A and 315B are continuous with the inclined surfaces 314A and 314B, respectively. Preferably, the rounded retaining flanges 315A and 315B extend from the tops of inclined surfaces 314A and 314B, respectively, to define an upper hook portion 316H above the ramp 316. Returning to FIGS. 4C-4D, the upper hook portion 316H has a configuration that compliments the configuration of dowel 324. The dowel 324 may be prevented from disengaging the ramp 316 by the upper hook portion 316H when moving upward.

FIG. 4D shows the traveling assembly 318 in an intermediate position between the highest position (shown in FIG. 4C) and a lowest position (not shown). Comparing the position of the traveling assembly 318 in FIG. 4D to that in FIG. 4C shows that the separation S has increased and that the dowel 324 has moved down the ramp 316. In the intermediate position, the lower edge 116L of the pivot door 116 is closer to the surface 128 than when the traveling assembly 318 is in the highest position.

Returning to FIG. 1, the pivot door assembly 100 may also include an upper adjustment assembly 400 to secure the upper beam end 110U to the horizontal jamb 126. The upper adjustment assembly 400 includes a top bracket 402 having an upper side 402U and a lower side 402L. The top bracket 402 is secured to the horizontal jamb 126 with the lower side 402L facing the surface 128. The top bracket 402 has a bore 404 in the lower side 402L thereof. The bore 404 is preferably cylindrical. In the illustrated example, the bore 404 extends completely through the top bracket 402 (i.e. from the lower side 402L through to the upper side 402U); however, it will be appreciated that this need not be the case.

In the illustrated example, the upper adjustment assembly 400 also includes a pair of upper locking fasteners 406A, 406B to releasably secure the top bracket 402 to the horizontal jamb 126. The upper locking fasteners 406A, 406B are adjustable between a first configuration and a second configuration. In the first configuration, the upper locking fasteners secure the top bracket 402 to the horizontal jamb 126. In the second configuration, the top bracket 402 is moveable in a horizontal direction relative to the horizontal jamb 126. The top bracket 402 has a corresponding pair of slotted openings 410A, 410B. Each upper locking fastener 406A, 406B passes through a corresponding slotted opening to engage the horizontal jamb 126 to secure the top bracket 402 to the horizontal jamb 126. Each upper locking fastener 406A, 406B can be positioned along the corresponding slotted opening in the second configuration.

The slotted openings 410A and 410B are positioned adjacent one another and spaced from the bore 404. It will be appreciated that only one or more than two locking fasteners and corresponding slotted openings can be used. It will also be appreciated that any other suitable way to releasably secure the top bracket may be used.

Figure 5:
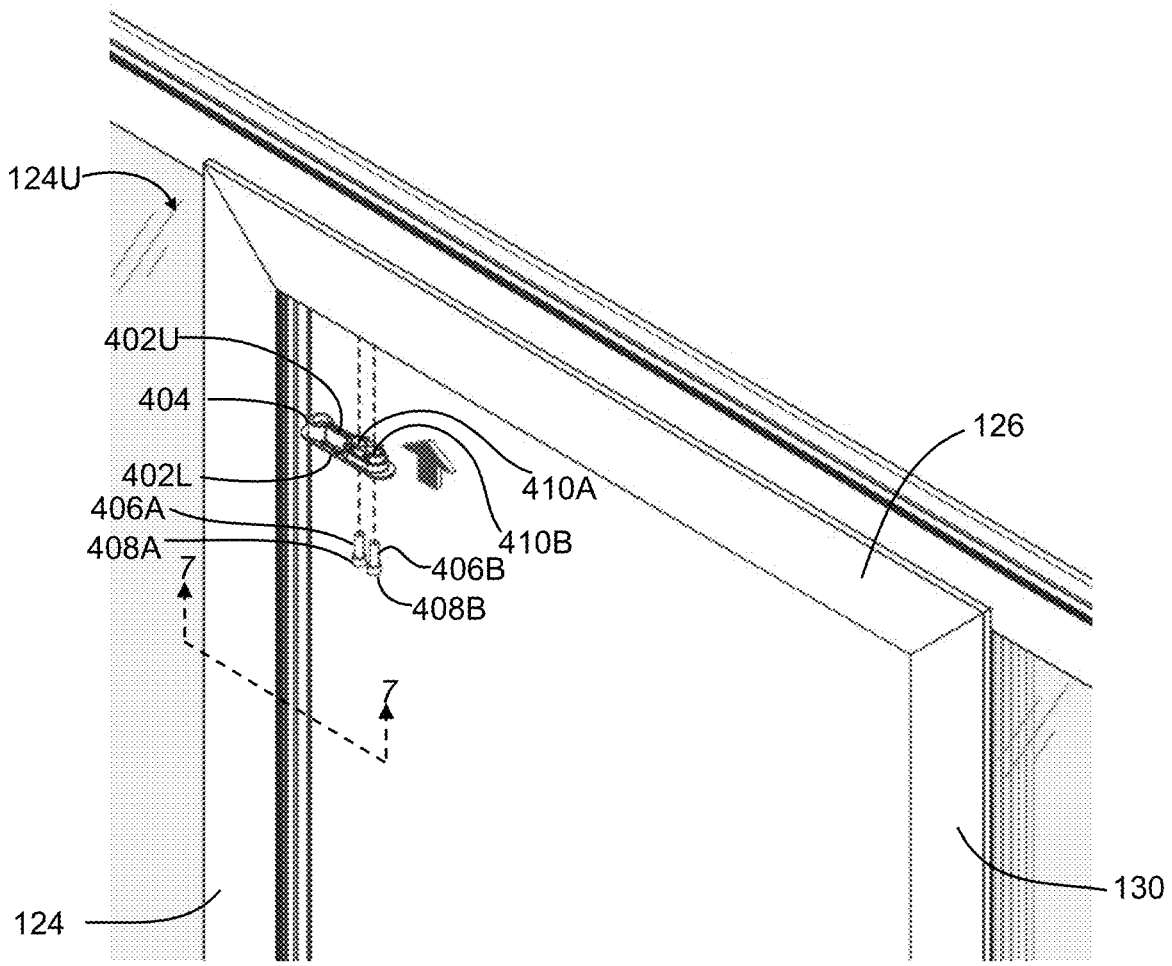
FIG. 5 is a partial exploded perspective view showing a top bracket of the pivot door assembly shown in FIG. 1 and the doorjamb.

FIG. 5 shows an example of the top bracket 402 being secured to a horizontal jamb 126. In the illustrated example, the upper locking fasteners 406A and 406B respectively pass through the slotted openings 410A and 410B of the top bracket 402 and engage the horizontal jamb 126 to releasably secure the top bracket 402 to the horizontal jamb 126. The threading of the upper locking fasteners 406A and 406B is omitted from FIGS. 1 and 5 for clarity.

Two upper locking fasteners (i.e. upper locking fasteners 406A and 406B) are used in the illustrated example to provide a more secure connection between the top bracket 402 and the horizontal jamb 126.

Figure 7:
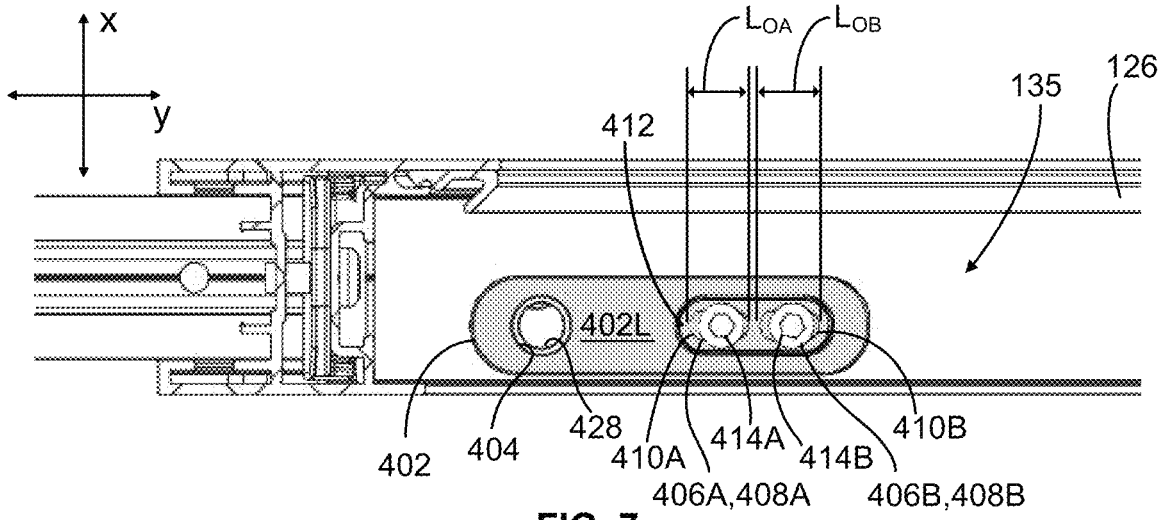
FIG. 7 is a cross-sectional view taken along line 7-7 of FIG. 5 showing the top bracket secured to the horizontal jamb.
Figure 14:
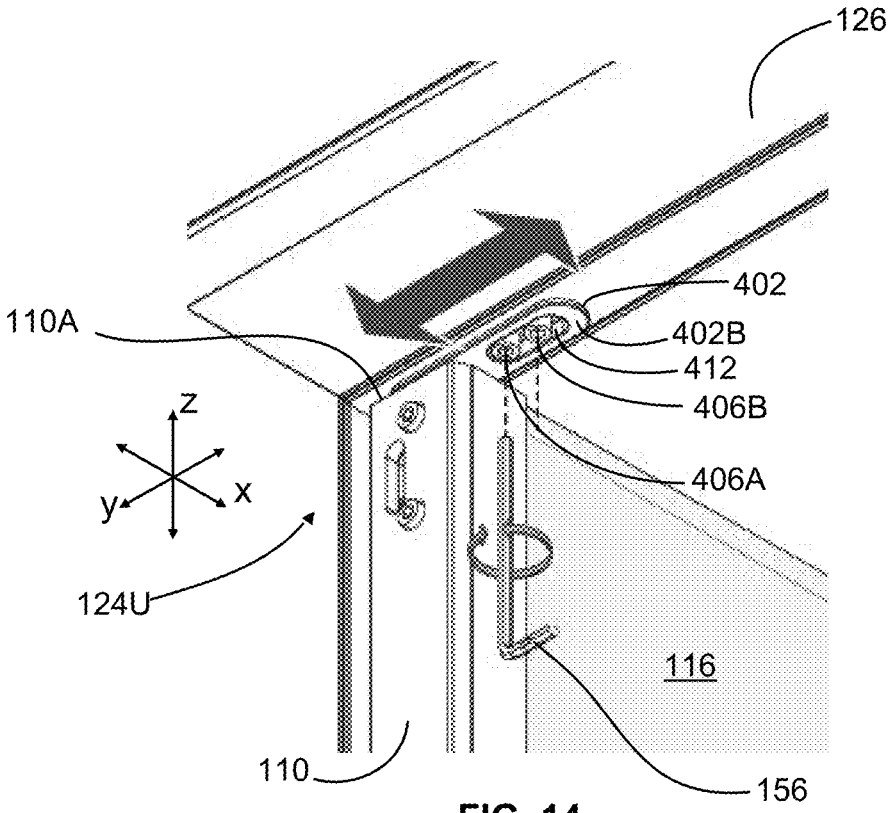
FIG. 14 is a partial perspective view showing adjustment of the pivot door of FIG. 9 from an upper end of the vertical jamb.

With continued reference to FIG. 5, the horizontal jamb 126 has a longitudinally extending recessed portion defining a jamb channel 135 (see FIG. 7). The top bracket 402 fits within the jamb channel 135 so that when the top bracket 402 is releasably secured to the horizontal jamb 126, it does not obstruct rotation of the pivot door 116. Preferably, the lower side 402L of the top bracket 402 is substantively flush with the horizontal jamb 126 when the top bracket 402 is releasably secured to the horizontal jamb 126, e.g. as shown in FIG. 14. In this arrangement, the top bracket 402 does not protrude into the door frame 122 and provides an aesthetically pleasing appearance.

Figure 6:
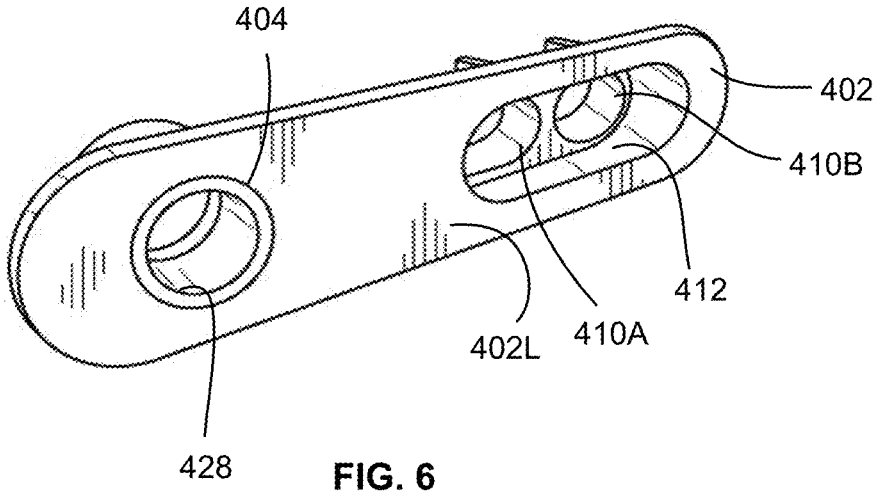
FIG. 6 is a perspective view of the top bracket shown in FIG. 5.

If the heads 408A and 408B of the upper locking fasteners 406A and 406B protrude from the lower side 402L of the top bracket 402, they may protrude from the horizontal jamb 126 and obstruct rotation of the pivot door 116. To reduce such occurrences, as shown in FIG. 6, the top bracket 402 has a sunken portion 412 defined in the lower side 402L. The slotted openings 410A and 410B are defined in the sunken portion 412. In this way, the sunken portion 412 offsets the slotted openings 410A and 4106 from the lower side 402L of the top bracket 402. The heads 408A and 408B of the upper locking fasteners sit in the sunken portion 412. The sunken portion 412 may prevent the heads 408A and 408B of the locking fasteners 406A and 406B from protruding outwardly from the top bracket 402 and the horizontal jamb 126 (e.g. as shown in FIG. 14).

FIG. 7 shows the top bracket 402 secured to the horizontal jamb 126. In the illustrated example, the upper locking fasteners 406A and 406B pass through the slotted openings 410A and 410B, respectively, and engage the horizontal jamb 126. When the upper locking fasteners 406A and 406B are in the first configuration, the sunken portion 412 surrounding the slotted openings 410A and 410B is pinned between the heads 408A and 408B of the locking fasteners 406A and 406B and the horizontal jamb 126. This secures the top bracket 402 to horizontal jamb 126 in the first configuration.

Conversely, when the upper locking fasteners 406A and 406B are in the second configuration, the upper locking fasteners 406A and 406B are loosened. In this arrangement, the top bracket 402 may move horizontally. The upper locking fasteners 406A and 406B can move along the slotted opening 410A and 410B, respectively, in the second configuration.

With continued reference to FIG. 7, an upper horizontal adjustment range of the top bracket 402 is determined by a length of the at least one slotted opening defined therethrough. It will be appreciated that the longer the length of the at least one slotted opening, the longer the upper horizontal adjustment range will be. In the illustrated example, the horizontal adjustment range is determined by a length $L_{OA}$ and a length $L_{OB}$ of the slotted openings 410A and 410B, respectively. In the illustrated example, the lengths $L_{OA}$ and $L_{OB}$ are generally equal. In cases where the slotted openings have different lengths, the smaller of the lengths will determine the horizontal adjustment range. In one exemplary embodiment, the upper horizontal adjustment range provided by the top bracket 402 is generally equivalent to the lower horizontal adjustment range provided by the bottom bracket 200.

In the illustrated example, the heads 408A and 408B of the upper locking fasteners 406A and 408B define hex-shaped axial openings 414A and 414B, respectively to engage an Allen key or the like. For example, the Allen key can be used to adjust to adjust the upper locking fasteners 406A and 406B between the first and second configurations.

Returning to FIG. 1, the upper adjustment assembly 400 also includes a plunger assembly 415 located within the beam channel 118. For example, the plunger assembly 415 can be inserted into the beam channel 118 from the upper beam end 110U. The plunger assembly 415 may include a main body 416, a generally cylindrical plunger 418, a spring 420, and a threaded locking pin 422. The main body 416 is secured to the beam 110 at the upper beam end 110U. The plunger 418 extends longitudinally between an upper plunger end 418U and a lower plunger end 418L. The plunger 418 is moveable between a retracted position and an extended positon. In the retracted position, the plunger 418 is located within the main body 416. In the extended position, the plunger 418 extends from the main body 416 and is received in the bore 404 of the top bracket 402.

The plunger 418 has a threaded transverse plunger bore 424 defined therein. The locking pin 422 engage the transverse plunger bore 424. In the example shown, the transverse plunger bore 424 is positioned closer to the lower plunger end 418L than the upper plunger end 418U. The locking pin 422 secures the plunger 418 to the main body 416 to prevent movement of the plunger 416.

With continued reference to FIG. 1, in the extended position, the plunger 418 extends axially into the bore 404 of the top bracket 402. In the illustrated example, the plunger 418 fits within the bore 404. Preferably, the diameter of the plunger 418 is slightly smaller than a diameter of the bore 404. When the plunger 418 is received in the bore 404, the plunger assembly 415 rotates relative to the top bracket 402 about an upper rotation axis 426 defined by the plunger 418. When assembled, the upper rotation axis 426 is generally co-axial with the pivot axis 120 defined by the beam 110.

Optionally, a bushing 428 can be positioned within the bore 404 of the top bracket 402. As shown in FIGS. 6 and 7, an outer surface of the bushing 428 can be secured to an inner surface of the bore 404. The bushing 428 may improve rotation of top bracket 402 about the plunger 418.

When the upper locking fasteners 406A and 406B are in the second configuration, the top bracket 402 can slide along the horizontal jamb 126 to space the pivot door 116 from the vertical jamb 124 at the upper end 124U. The horizontal movement of the top bracket 402 shifts the upper rotation axis 426 defined by the plunger 418 which, in response, shifts the pivot axis 120 defined by the beam 110.

Figure 8A:
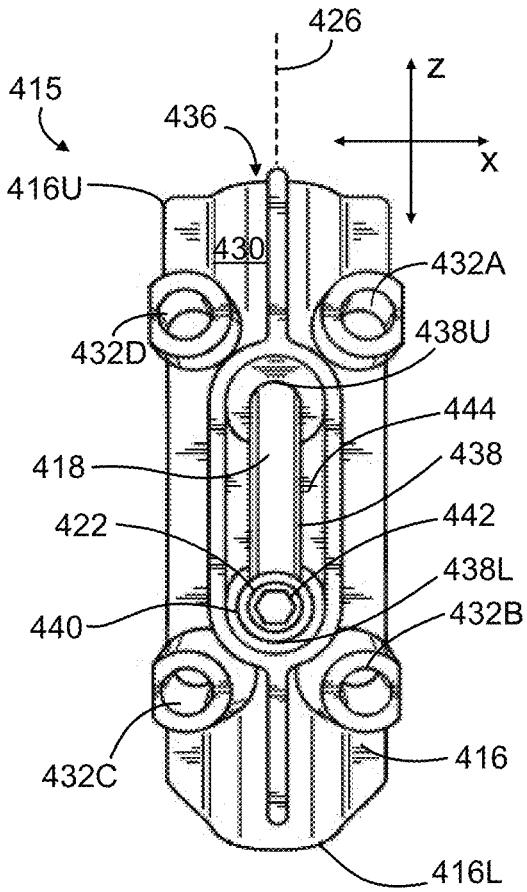
FIGS. 8A and 8B are front elevation views of a plunger assembly of the pivot door assembly shown FIG. 1 in retracted and extended positions, respectively.

Turning to FIG. 8A, the main body 416 of the plunger assembly 415 has an upper end 416U, a lower end 416L and a beam-engagement side 430 extending therebetween. The beam-engagement side 430 can be secured to the beam 110 in a number of suitable ways, e.g. by mechanical fasteners, adhesive, etc.

In the illustrated example, the four threaded apertures 432A, 432B, 432C, 432D are defined in the beam-engagement side 420. The threaded apertures 432A, 432B, 432C and 432D are positioned in a rectangular configuration on the beam-engagement side 430. Returning to FIG. 1, the plunger assembly 315 includes a pair of threaded fasteners 434A and 434B. The threaded fasteners 434A and 434B are received in the apertures 432A and 432B. The threaded fasteners 434A and 434B engage the apertures 432A and 432B defined in the beam-engagement side 430 through corresponding openings 142A and 142B defined through a side the beam 110 to secure the main body 316 to the beam 110.

The main body 416 of the plunger assembly 415 is preferably located within the beam channel 118 so that when secured to the beam 110, the upper end 416U of the main body 416 is generally level with the upper beam end 110U. The openings 142A and 1426 may be located in the beam 110 to generally level the upper end 416U of the main body 416 with the upper beam end 110U.

Referring to FIG. 1, the main body 416 of the plunger assembly 315 has a longitudinally extending body channel 436 defined partially therethrough. The body channel 436 extends from an open top end at the upper end 416U of the main body 416 to a closed bottom end proximate the lower end 416L of the main body 416. When axially aligned, the plunger 418 and the spring 420 fit within the channel 436. The plunger 418 is supported by the spring 420 within the channel 436. The spring 420 biases the plunger 418 toward the extended positon. The spring 420 is preferably a coil spring, e.g. as shown in FIG. 1.

In some embodiments (not shown), the plunger 418 defines an upwardly extending plunger cavity in lower plunger end 418L thereof. The plunger cavity may receive an end of the spring 420. Accordingly, when the plunger 418 and spring 420 are axially aligned in the body channel 436, at least a portion of the spring 420 is inserted into the plunger cavity.

Returning to FIG. 8A, the beam-engagement side 430 of the main body 416 also has a longitudinally extending elongated body slot 438 defined therein. The elongated body slot 438 has an upper body slot end 438U and a lower body slot end 438L. The locking pin 422 engages the transverse plunger bore 424 through the elongated body slot 438 defined in the beam-engagement side 430. In the illustrated example, the locking pin 422 includes a head 440 defining a hex-shaped axial opening 442 to engage an Allen key or the like.

Returning to FIG. 1, the elongated body slot 438 is generally aligned with a longitudinally extending elongated access slot 144 defined through a side of the beam 110. When assembled, the locking pin 422 passes through the elongated body slot 438 and the elongated access slot 144 to engage the transverse plunger bore 424. The elongated access slot 144 preferably matches the configuration of the elongated body slot 438 defined in the beam-engagement side 430 of the main body 416.

In the illustrated example, the main body 416 has a sunken portion 444 defined in beam-engagement side 430. Referring to FIG. 8A, the elongated body slot 438 is defined in the sunken portion 444. The head 440 of the locking pin 422 sits in the sunken portion 444. By offsetting the elongated body slot 438 from the beam-engagement side 430, the sunken portion 444 prevents the head 440 of the locking pin 422 from protruding from the beam-engagement side 430 of the main body 416. Since the elongated body slot 438 is generally aligned with the elongated access slot 144 defined in the beam 110, the sunken portion 444 may also prevent the head 440 of the locking pin 422 from protruding from the beam 110. In this way, the head 440 of the locking pin 422 does not obstruct rotation of the pivot door 116.

As noted above, the locking pin 422 can secure the plunger to the main body 416 to prevent movement of the plunger 418. The locking pin 422 is adjustable between a constrained configuration and a released configuration. In the constrained configuration, the locking pin 422 secures the plunger 418 to the main body 416 to prevent movement of the plunger. When the locking pin 422 is in the constrained configuration, the head 440 of the locking pin 422 is held tightly against the sunken portion 444 of the beam-engagement side 430. This effectively prevents the locking pin 422 from moving along the elongated body slot 438 (i.e. between the lower slot end 438L and the upper slot end 438U).

In the released configuration, the plunger 418 is movable along the body channel 436 between the retracted and extended positons. When the locking pin 422 is in the released configuration, engagement between the head 440 of the locking pin 422 and the sunken portion 444 of the beam-engagement side 430 is loosened. This effectively permits the locking pin 422 to move along the elongated slot 438. In the illustrated example, the locking pin 422 can be adjusted between the constrained and released configurations with an Allen key.

FIG. 8A shows the plunger 418 of the plunger assembly 415 in the retracted position. When the locking pin 422 is positioned at the lower slot end 438L, the plunger 418 is fully retracted within the main body 416. Put alternatively, the upper plunger end 418U does not protrude from the upper end 416U of the main body 416 in the retracted position. When the plunger 418 is in the retracted position, the spring 420 is compressed between the lower plunger end 418L and the closed bottom end of the channel 436.

As described above, the main body 416 is preferably secured to the beam 110 so that the upper end 416U of the main body 416 is generally level with the upper beam end 110U. In such an arrangement, in retracted position, the plunger 418 is located within the beam channel 118. That is, the upper plunger end 418U does not protrude from the upper beam end 110U. If the upper plunger end 418U were to protrude from the upper beam end 110U during installation it may obstruct, or make it difficult, to position the pivot door 116 within the door frame 122. Accordingly, positioning of the pivot door 116 within the door frame 122 for installation and/or assembly is simplified when the plunger 418 is in the retracted position and located within the beam channel 118.

When the plunger 418 is in the retracted position as the locking pin 422 is adjusted from the constrained configuration to the released configuration the spring 420 forces the plunger to move toward the extended position. The plunger 418 moves upward within the body channel 436 to the extended position. Accordingly, in the illustrated example, the plunger assembly 415 may be characterized as a "spring-loaded" or "spring-assisted" plunger assembly 415.

Figure 8B:
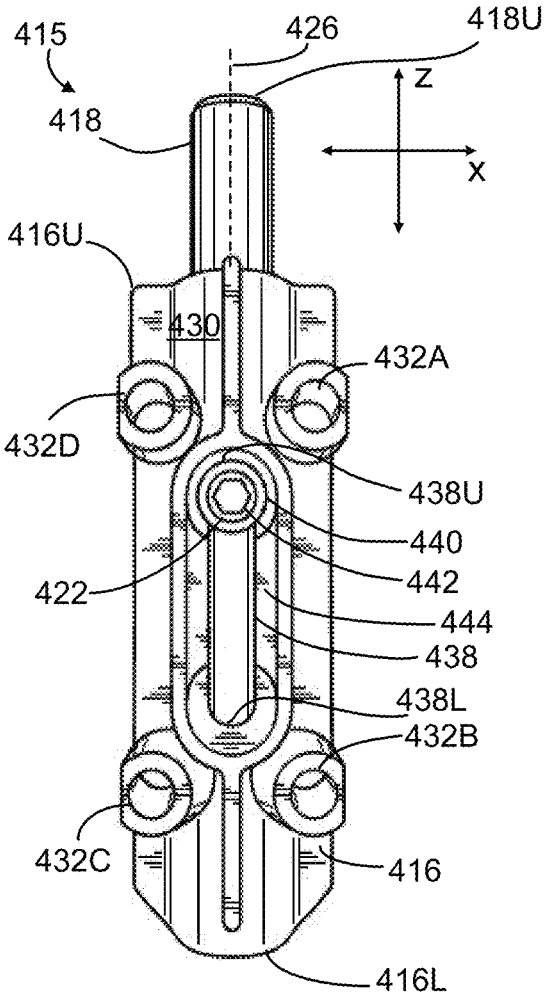

FIG. 8B shows the plunger 418 of the plunger assembly 416 in the extended position. In the extended position, the plunger 418 extends from the upper end 416U of the main body 416. When the plunger 418 is in the extended position, the locking pin 422 is positioned at the upper slot end 438U. In the extended position, the plunger 418 protrudes from the beam channel 418 at the upper beam end 110U. In this arrangement, the plunger 418 may extend into the bore 404 of the top bracket 402.

It will be appreciated that in one or more alternative embodiments, the spring 420 may be omitted from the plunger assembly 415. In such embodiments, the locking pin 422 can be moved manually along the elongated body slot 438 (e.g. from the lower slot end 438L to the upper slot end 438U) to adjust the plunger 418 between the retracted and extended positions.

Figure 10A:
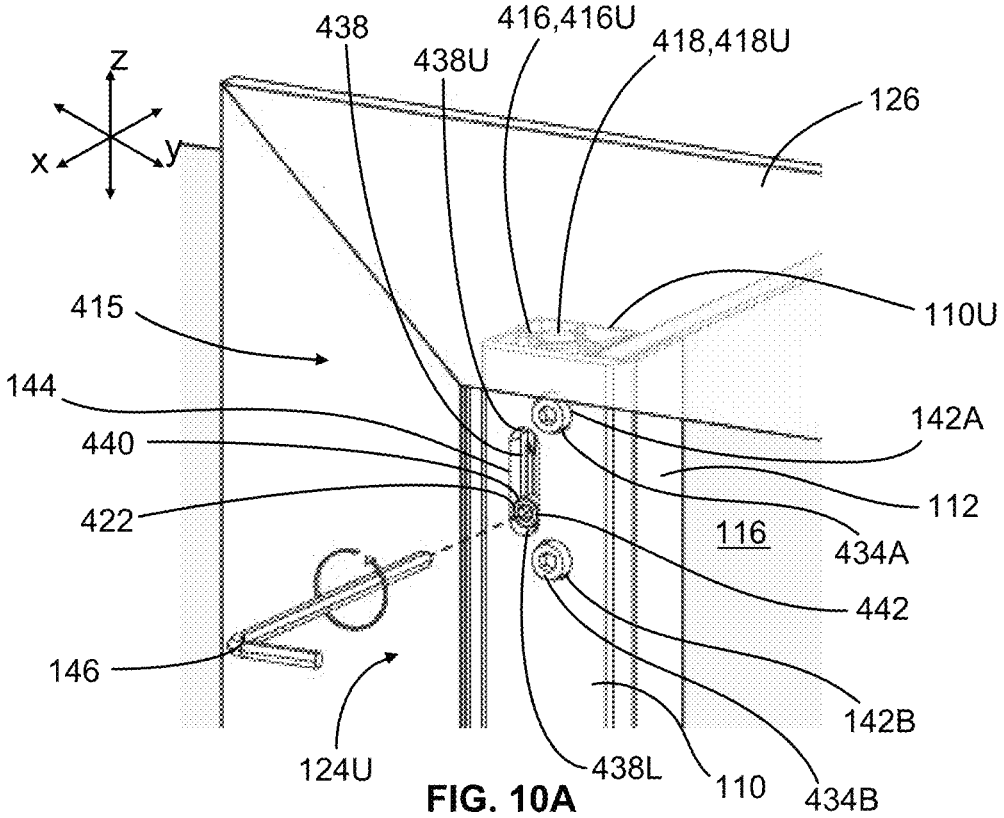
FIGS. 10A and 10B are partial perspective views showing two stages of securing the pivot door of FIG. 9 to the horizontal jamb with the plunger assembly shown in FIGS. 8A-8B.
Figure 10B:
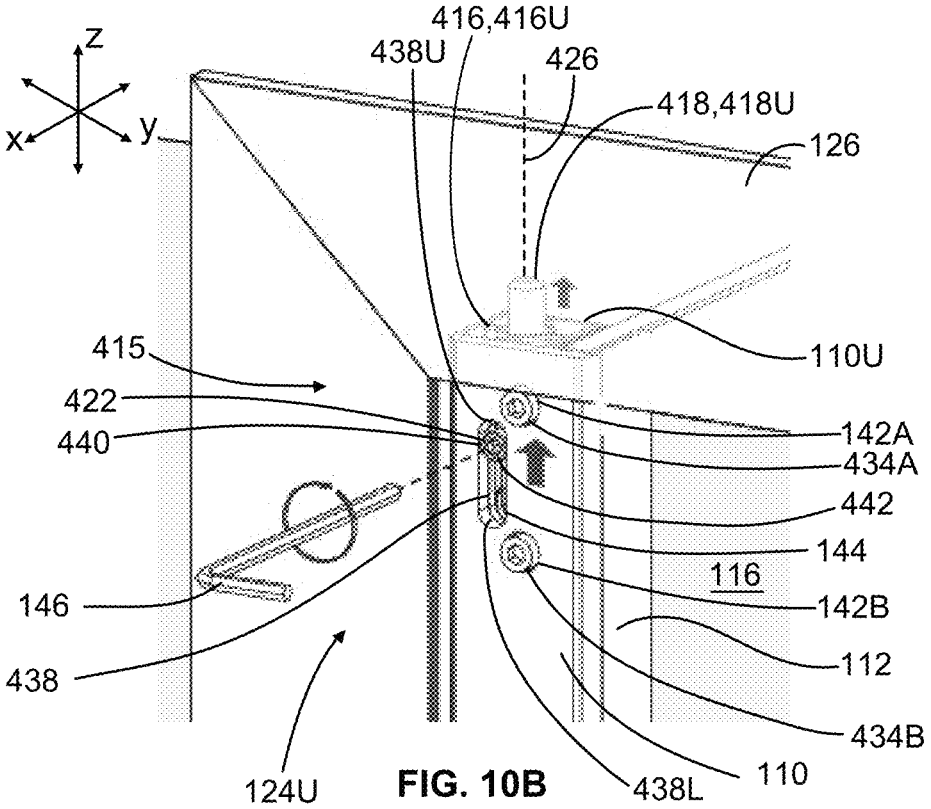

Reference is now made to FIGS. 9 and 10A-10B to describe the installation of the pivot door 116 in the door frame 122 with the pivot door assembly 100. As described above, the door frame 122 includes the at least one vertical jamb 124 and the horizontal jamb 126.

Referring specifically to FIG. 9, the pivot door 116 is first positioned so the pin 204 of the bottom bracket 200 can be inserted into the beam channel 118 from the lower beam end 110L. The pivot door 116 is then lowered so that the lower beam end 110L sits on the bottom bracket 200. In this arrangement, the pin 204 of the bottom bracket 202 engages the cavity 306 of the pivot member 302. Next, the pivot door 116 is positioned so that the plunger 418 of the plunger assembly 415 (previously secured within the beam channel 118 at the upper beam end 110U) aligns with the bore 404 of the top bracket 402. In the illustrated example, when the pivot door 116 is positioned within the door frame 122, the plunger 418 is in the retracted position and the locking pin 422 is in the constrained configuration to prevent movement of the plunger 418.

Referring specifically to FIG. 10A, the plunger 418 is in the retracted position and held in position by the locking pin 422 in the constrained configuration. FIG. 10A shows an Allen key 146 adjusting the locking pin 422 from the constrained position to the released position (i.e. by loosening the locking pin 422, e.g. as shown). As described above, when the plunger 418 is in the retracted position while the locking pin 422 is adjusted from the constrained configuration to the released configuration, the spring 420 forces the plunger 418 upward within the body channel 436 to the extended position.

Referring specifically to FIG. 10B, the plunger 418 is in the extended position. In the extended position, the plunger 418 extends into the bore 404 of the top bracket 402 to rotatably couple the upper beam end 110U to the top bracket 402. As described above, the plunger assembly 415 rotates relative to the top bracket 402 about the upper rotation axis 426 defined by the plunger 418. The top bracket 402 is omitted from FIGS. 10A and 10B for clarity.

With continued reference to FIG. 10B, optionally, the locking pin 422 can be adjusted from the released configuration to constrained configuration once the plunger is in the extended position (i.e. by tightening the locking pin 422, e.g. as shown). As a result, the plunger 418 may be secured in the extended position while engaged with the bore 404. This may reduce the likelihood of the upper beam end 110U becoming disconnected from the top bracket 402.

It will be appreciated that the pivot door 116 may be disassembled from the pivot door assembly 100 (i.e. removed/uninstalled from the door frame 122) by following the process described above in reverse.

Figure 12B:
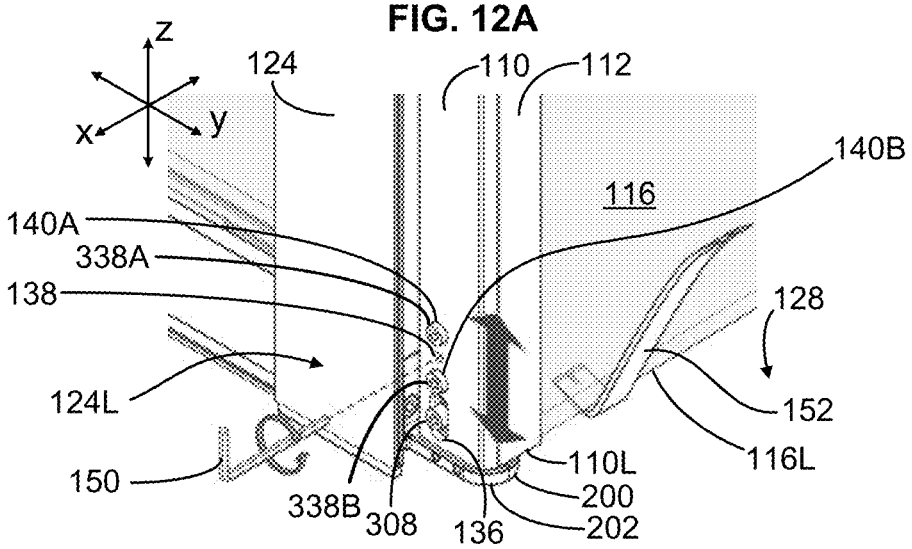
Figure 12C:
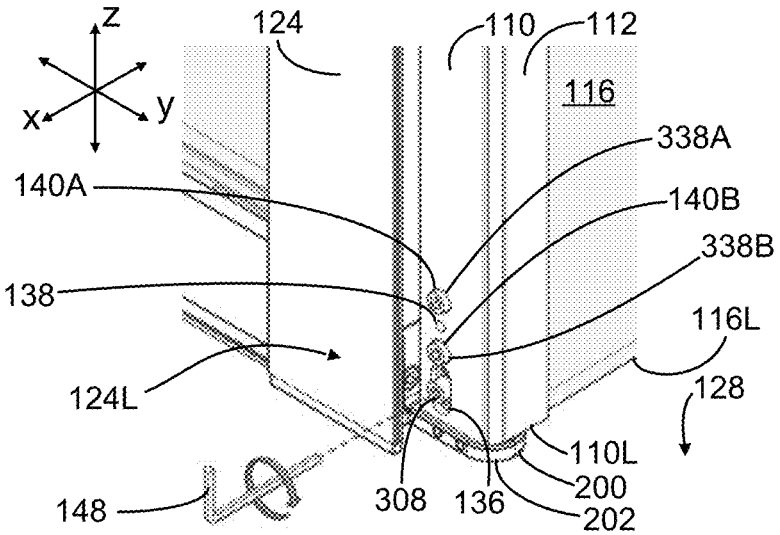

Reference is now made to FIGS. 12A-12C to describe vertical adjustment of the lower edge 116L of the pivot door 116 from the floor 128 using the lower adjustment assembly 300. FIG. 12A shows an Allen key 148 adjusting the locking fastener 308 from the locked configuration to the unlocked configuration (i.e. by loosening the locking fastener 308). As shown, the head 312 of the locking fastener 308 is accessible via the adjustment slot 136 defined though a side of the beam 110.

Referring specifically to FIG. 12B, the locking fastener 308 is in the unlocked configuration. As described above, in the unlocked configuration, the beam 110 is movable vertically relative to pivot body 302. FIG. 12B shows an Allen key 150 turning (either clockwise or counterclockwise) the adjustment rod 328 via the access hole 138 defined through the side of the beam 110. In the unlocked configuration, rotation of the adjustment rod 328 moves the traveling assembly 318 vertically in relation to the pivot member 302. As described above, the traveling body 320 of the traveling assembly 318 is secured to the beam 110. As a result, moving the traveling assembly 318 vertically relative to the pivot member 302 correspondingly moves the beam 110 vertically relative to the pivot member 302. In this way, rotating the adjustment rod 328 can space the lower edge 116L of the pivot door 116 from the floor 128.

With continued reference to FIG. 12B, a pry bar 152 is optionally used to take a portion of the pivot door's weight off the lower adjustment assembly 300. In doing so, the pry bar 152 may reduce the torque required to rotate the adjustment rod 328.

Referring specifically to FIG. 12C, once the lower edge 116L of the pivot door 116 is desirably spaced from the surface 128, the Allen Key 148 is used to adjust the locking fastener 308 from the unlocked configuration to the locked configuration. As described above, in the locked configuration, the beam 110 is secured to the pivot member 302 of the lower adjustment assembly 300. Put alternatively, the beam 110 cannot move vertically relative to the pivot member 302 in the locked configuration. As a result, the previously set spacing between the lower edge 116L of the pivot door 116 and the floor 128 may be maintained when the locking fastener 308 is in the locked configuration.

Figure 13:
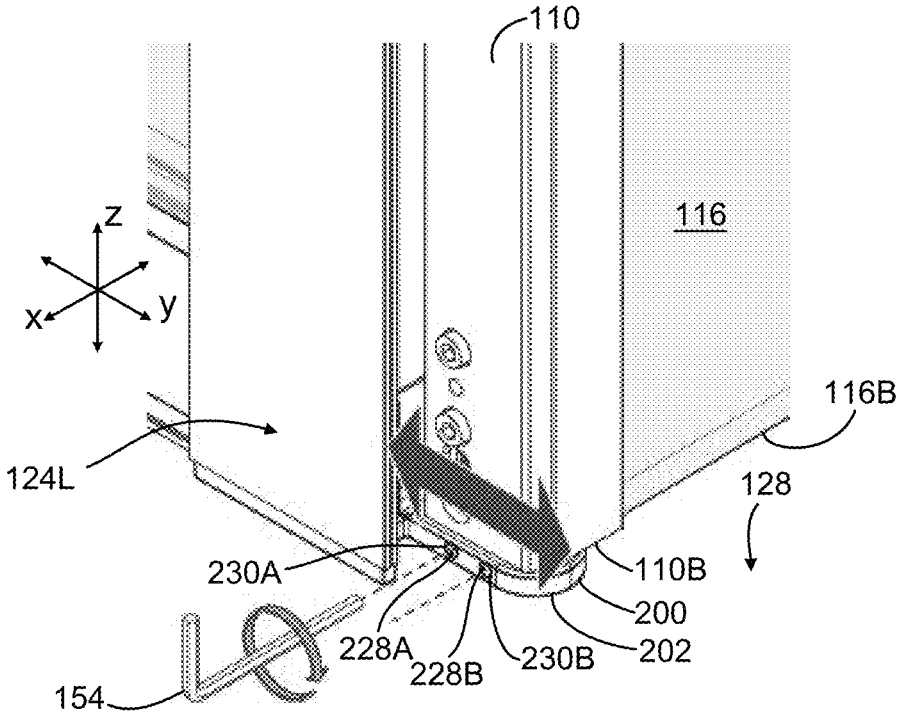
FIG. 13 is a partial perspective view showing adjustment of the pivot door of FIG. 9 from the lower end of the vertical jamb.

Reference is now made to FIG. 13 to describe horizontal adjustment of the pivot door 116 from the vertical jamb 124 at the lower end 124L thereof with the pivot door assembly 100. FIG. 13 shows an Allen key 154 capable of tightening and loosening the set screws 228A and 228B via threaded holes 230A and 230B defined on the base 202. As described above, when the set screws 228A and 228B have been sufficiently loosened, the block 224 can slide on the recessed sliding surface 220. Since the pin 204 extends upwardly from the block 224, sliding the block 224 concurrently slides the pin 204.

Since the pin 204 is engaged with the cavity 306 of the pivot member 302 and the pivot member 302 is secured to the beam 110 (e.g. as described above), moving the beam 110 correspondingly slides the block 224 on the recessed sliding surface 220. Sliding the block 224 shifts the lower rotation axis 206 defined by the pin 204, thereby spacing the beam 110 from the vertical jamb 124 at the lower end 124L thereof.

Once the pivot door 116 is desirably spaced from the vertical jamb 124 at the lower end 124L thereof, the Allen Key 154 is used to tighten the set screws 228A and 228B. When the set screws 228A and 228B have been sufficiently tightened, the block 224 is secured to the base 202. When sufficiently tightened, the set screws 228A and 228B protrude from the threaded holes 230A and 230B to pin the block 224 in a set position on the recessed sliding surface 220. Accordingly, the previously set spacing between the beam 110 and the vertical jamb 124 at the lower end 124L thereof may be maintained.

Reference is now made to FIG. 14 to describe horizontal adjustment of the pivot door 116 from the vertical jamb 124 at the upper end 124U thereof. FIG. 14 shows an Allen key 156 capable of tightening and or loosening the upper locking fasteners 406A and 406B between the first and second configurations. As described above, in the first configuration, the upper locking fasteners secure the top bracket 402 to the horizontal jamb 126. In the second configuration, the top bracket 402 is horizontally moveable along the horizontal jamb 126.

Since the plunger 418 of the plunger assembly 415 is engaged with the bore 404 of the top bracket 402 and the plunger assembly 415 is secured to the beam 110 (e.g. as described above), in the second configuration, moving the beam 110 correspondingly moves the top bracket 402 horizontally relative to the horizontal jamb 126. As a result, moving the top bracket 402 shifts the upper rotation axis 426 defined by the plunger 418, thereby spacing the beam 110 from the vertical jamb 124 at the upper end 124U thereof.

Once the pivot door 116 is desirably spaced from the vertical jamb 124 at the upper end 124U thereof, the Allen Key 156 is used to adjust the upper locking fasteners 406A and 406B from the second configuration to the first configuration. When the upper locking fasteners 406A and 406B are in the first configuration, the top bracket 402 is secured to the horizontal jamb 126. As a result, the previously set spacing between the beam 110 and the vertical jamb 124 at the upper end 124 thereof may be maintained in the first configuration.

Preferably, the beam 110 is simultaneously spaced from the upper and lower ends 124U and 124L of the vertical jamb 124. The pin 204 of the bottom bracket 200 and the bore 404 of the top bracket 402 cooperate to orient the pivot axis 120 defined by the beam 110. As a result, moving the bottom bracket 200 and the top bracket 402 (as described above with reference to FIGS. 13 and 14) in unison shifts the pivot axis 120 defined by the beam 110 of the pivot door 116.

It will be appreciated that operation of the pivot door 116 can be improved when the lower rotation axis 206 defined by the pin 204 and the upper rotation axis 426 defined by the plunger 418 are generally co-axial.

The pivot door assembly 100 described herein accommodates for variations in floor to ceiling dimensions and manufacturing tolerances of the components used therein. In addition, the pivot door assembly 100 facilitates easy assembly and disassembly, which has several advantages. One advantage is the ability by the owner to disassemble the assembly and reassemble it in a different door frame. A second advantage is the assembly is beneficial for the environment because it can be reused and does not necessarily require disposal if the owner of the assembly moves to a new building or renovates their existing building.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A pivot assembly for supporting a pivot door within a door frame, the door frame having a vertical jamb and a horizontal jamb, the pivot door having a beam along a vertical side edge thereof, the beam defining a longitudinal beam channel therein, the pivot assembly comprising:

A. a bottom bracket configured to be located at a lower end of the vertical jamb, the bottom bracket comprising a base and a pin extending upwardly from the base, the base having a lower resting surface; and B. a lower adjustment assembly configured to be located within the beam channel, the lower adjustment assembly comprising:

i. a pivot member supported on the pin, the pivot member having a bottom surface and an upper portion, wherein the pivot member defines a cavity extending upwardly from the bottom surface of the pivot member, wherein the cavity is adapted to receive the pin, wherein the pivot member is rotatable relative to the bottom bracket about a lower rotation axis defined by the pin, the upper portion of the pivot member comprising a ramp inclined at an angle to the lower rotation axis;

ii. a traveling assembly positionable along the ramp of the pivot member, the traveling assembly comprising:

a) a traveling body having a beam-engagement surface and an aperture extending from the beam-engagement surface through the traveling body;

b) a dowel defining a threaded transverse dowel bore therethrough, wherein the dowel is adapted to move along the ramp; and c) a threaded adjustment rod configured to couple the dowel and the traveling body, wherein the adjustment rod is adapted to pass through the aperture of the traveling body and threadedly engage the transverse dowel bore;

wherein the beam-engagement surface of the traveling body is configured to be secured to the beam, iii. a locking fastener configured to operatively couple the pivot member to the beam, the locking fastener being adjustable between a locked configuration and an unlocked configuration, wherein, in the locked configuration, the locking fastener is adapted to secure the pivot member to the beam, and wherein, in the unlocked configuration, the locking fastener permits movement of the beam in a vertical direction relative to the pivot member; and wherein, in the unlocked configuration, rotation of the adjustment rod causes movement of the traveling assembly vertically relative to the pivot member, thereby permitting the beam to move vertically relative to the pivot member.

2. The pivot assembly of claim 1, wherein, in the unlocked configuration, rotation of the adjustment rod moves the dowel of the traveling assembly along the ramp of the pivot member.

3. The pivot assembly of claim 2, wherein the aperture of the traveling body has a countersunk portion and the adjustment rod comprises a head configured to sit in the countersunk portion substantially flush with the beam-engagement surface.

4. The pivot assembly of claim 3, wherein the head of the adjustment rod has a hex-shaped axial opening defined therein, wherein the hex-shaped axial opening is accessible via an access hole defined through a side of the beam and is configured to engage an Allen key.

5. The pivot assembly of claim 1, wherein the bottom bracket further comprises a plate extending generally upwardly and perpendicularly from the base, wherein the plate is securable to the lower end of the vertical jamb.

6. The pivot assembly of claim 5, wherein the plate is configured to at least partially fit within a longitudinally extending jamb channel defined by a recessed portion of the vertical jamb.

7. The pivot assembly of claim 1, wherein a transverse threaded aperture is defined in a side surface of the pivot member, wherein the locking fastener comprises a threaded fastener having a head, and wherein the locking fastener is configured to threadedly engage the aperture of the pivot member, wherein the locking fastener is configured to pass through a longitudinally extending adjustment slot defined in a side of the beam to releasably secure the beam to the pivot member in the locked configuration, wherein, in the unlocked configuration, the adjustment slot permits movement of the beam relative to the pivot member.

8. The pivot assembly of claim 1, wherein the traveling body has at least one threaded hole defined in the beam-engagement surface, wherein the traveling assembly further comprises at least one beam-engagement fastener, wherein, the at least one beam-engagement fastener is configured to threadedly engage the at least one hole defined in the beam-engagement surface, wherein the beam-engagement fastener passes through a corresponding hole defined through a side the beam to secure the beam to the traveling body.

9. The pivot assembly of claim 1, wherein the base of the bottom bracket comprises a recessed sliding surface supporting a block configured for generally horizontal sliding movement along the sliding surface, the pin extending upwardly from the block, wherein horizontal movement of the pin shifts the lower rotation axis.

10. The pivot assembly of claim 9, wherein the bottom bracket further comprises at least one set screw configured to releasably secure the block in a predetermined position on the sliding surface.

11. The pivot assembly of claim 10 further comprising an upper adjustment assembly, the upper adjustment assembly comprising:

a top bracket having a bore defined therethrough;

at least one upper locking fastener configured to releasably secure the top bracket to the horizontal jamb, the at least one upper locking fastener being adjustable between a first configuration and a second configuration, wherein, in the first configuration, the at least one upper locking fastener is adapted to secure the top bracket to the horizontal jamb, and wherein, in the second configuration, the top bracket is movable in a horizontal direction; and a plunger assembly configured to be located within the beam channel, the plunger assembly comprising a plunger moveable between a retracted position and an extended position, wherein, in the retracted position, the plunger is located within the beam channel, wherein, in the extended position, the plunger extends from the beam channel and is adapted to be received in the bore, thereby permitting pivoting of the plunger assembly relative to the top bracket about an upper rotation axis defined by a longitudinal axis of the plunger;

wherein, in the second configuration, horizontal movement of the top bracket horizontally shifts the upper rotation axis.

12. The pivot assembly of claim 11, wherein the top bracket defines least one slotted opening therein, wherein the at least one upper locking fastener is configured to pass through the at least one slotted opening and engage the horizontal jamb to releasably secure the top bracket to the horizontal jamb, and wherein, in the second configuration, the at least one upper locking fastener is adapted for movement along the at least one slotted opening.

13. The pivot assembly of claim 12, wherein the top bracket is configured to substantially fit within a longitudinally extending jamb channel defined by a recessed portion of the horizontal jamb, and wherein, when the top bracket is releasably secured to the horizontal jamb within the horizontal jamb channel, wherein a lower surface of the top bracket is generally flush with the horizontal jamb.

14. The pivot assembly of claim 11, wherein the plunger assembly further comprises a main body configured to be secured to the beam, the main body having an upper end, a lower end, and a body channel defined partially therethrough, the body channel extending from an open top end at the upper end of the main body to a closed bottom end proximate the lower end of the main body, wherein the plunger is moveable along the channel, wherein, in the extended position, the plunger extends from the upper end of the main body, and wherein, in the retracted position, the plunger is retracted within the main body.

15. The pivot assembly of claim 14, wherein the plunger assembly further comprises a threaded locking pin configured to releasably secure the plunger to the main body to prevent movement of the plunger.

16. The pivot assembly of claim 15, wherein the main body comprises a beam-engagement side securable to the beam, the beam-engagement side having a longitudinally extending elongated body slot defined therein, wherein the body slot is generally aligned with a corresponding longitudinally extending elongated access slot defined though a side of the beam, wherein the plunger has a transverse plunger bore defined therein, wherein the locking pin is configured to pass through the body slot and the access slot to threadedly engage the transverse plunger bore.

17. The pivot assembly of claim 16, wherein the plunger assembly further comprises a spring located in the channel between the closed end of the channel a lower end of the plunger, wherein the spring is configured to bias the plunger toward the extended position.

18. The pivot assembly of claim 16, wherein the beam-engagement side of the main body has at least one threaded aperture defined therein, wherein the plunger assembly further comprises the at least one fastener configured to pass through the beam and threadedly engage the threaded aperture, thereby securing the main body to the beam.

19. A pivot door assembly for a door frame having a vertical jamb, the vertical jamb having an upper end a lower end, the pivot door assembly comprising:

A. a generally vertical beam configured to be positioned proximate to the vertical jamb, the beam defining a longitudinal beam channel therein;

B. a bottom bracket located at the lower end of the vertical jamb, the bottom bracket comprising a base and a pin extending upwardly from the base, the base having a lower resting surface; and C. a lower adjustment assembly positionable within the beam channel, the lower adjustment assembly comprising:

i. a pivot member supported on the pin, the pivot member having a bottom surface and an upper portion, wherein the pivot member defines a cavity extending upwardly from the bottom surface of the pivot member, wherein the cavity is adapted to receive the pin, wherein the pivot member is rotatable relative to the bottom bracket about a lower rotation axis defined by the pin, the upper portion of the pivot member comprising a ramp inclined at an angle to the lower rotation axis;

ii. a traveling assembly positionable along the ramp, the traveling assembly comprising:

a) a traveling body having a beam-engagement surface and an aperture extending from the beam-engagement surface through the traveling body;

b) a dowel defining a threaded transverse dowel bore therethrough, wherein the dowel is adapted to move along the ramp; and c) a threaded adjustment rod configured to couple the dowel and the traveling body, wherein the adjustment rod is adapted to pass through the aperture of the traveling body and threadedly engage the transverse dowel bore;

wherein the beam-engagement surface of the traveling body is configured to be secured to the beam, iii. a locking fastener configured to operatively couple the pivot member to the beam, the locking fastener being adjustable between a locked configuration and an unlocked configuration, wherein, in the locked configuration, the locking fastener is adapted to secure the pivot member to the beam, and wherein, in the unlocked configuration, the beam is movable in a vertical direction relative to the pivot member; and wherein, in the unlocked configuration, rotation of the adjustment rod causes vertical movement of the traveling assembly relative to the pivot member, thereby permitting the beam to move vertically relative to the pivot member.

20. The pivot assembly of claim 19, wherein the base of the bottom bracket comprises a recessed sliding surface supporting a block configured for generally horizontal sliding movement along the sliding surface, the pin extending upwardly from the block, wherein horizontal movement of the pin shifts the lower rotation axis.

* * * * *